US007801454B2

(12) United States Patent
Furukawa et al.

(10) Patent No.: US 7,801,454 B2
(45) Date of Patent: Sep. 21, 2010

(54) IMAGE FORMATION APPARATUS AND PREPARATION OPERATION EXECUTION METHOD

(75) Inventors: Kunio Furukawa, Toyokawa (JP); Takashi Honda, Toyokawa (JP); Shiro Umeda, Toyokawa (JP); Takahiro Tsujimoto, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 35 days.

(21) Appl. No.: 12/408,120

(22) Filed: Mar. 20, 2009

(65) Prior Publication Data

US 2009/0317103 A1 Dec. 24, 2009

(30) Foreign Application Priority Data

Jun. 20, 2008 (JP) ..... 2008-162162

(51) Int. Cl.
*G03G 15/00* (2006.01)

(52) U.S. Cl. ..... 399/49; 399/70

(58) Field of Classification Search ..... 399/46, 399/49, 67–70

See application file for complete search history.

(56) References Cited

U.S. PATENT DOCUMENTS 6,501,919 B1 * 12/2002 Yamaguchi ..... 399/70
6,992,784 B1 * 1/2006 Kohtani et al. ..... 358/1.15
7,092,652 B2 * 8/2006 Matsumoto ..... 399/70

FOREIGN PATENT DOCUMENTS

JP 2001-356664 12/2001
JP 2004-126329 4/2004

* cited by examiner

*Primary Examiner*—Hoang Ngo
(74) *Attorney, Agent, or Firm*—Morrison & Foerster LLP

(57) ABSTRACT

Upon completing a preparation operation including different processes, an image formation apparatus shifts to ready state in which image formation is executable, the processes including at least one process executed using a corresponding motor. The image formation apparatus comprises: an obtainer for obtaining, for each process, an estimated time period between start and completion thereof; and a controller for starting execution of, out of the processes, (i) one process whose estimated time period is the longest, then (ii) any other process so that any other process is executed in parallel with said one process. When said one process is included in the at least one process, the controller initiates the motor by high-speed initiation by applying thereto first voltage that is higher than second voltage. When any other process is included in the at least one process, the controller initiates the motor by normal initiation by applying thereto first voltage.

20 Claims, 11 Drawing Sheets

(A)

(B)

IMAGE FORMATION APPARATUS AND PREPARATION OPERATION EXECUTION METHOD

This application is based on application No. 2008-162162 filed in Japan, the contents of which are hereby incorporated by reference.

BACKGROUND OF THE INVENTION

1. Field of the Invention

The present invention relates to an image formation apparatus, such as a photocopier, and a preparation operation execution method. In particular, the present invention relates to an image formation apparatus and a preparation operation execution method for (i) executing a preparation operation including a plurality of different processes, and (ii) upon completion of the preparation operation, shifting to a ready state in which an image formation operation is executable.

2. Related Art

A tandem color image formation apparatus is, for example, configured in the following manners: image forming units for different colors are arranged along an intermediate transfer belt; the image forming units transfer toner images formed on the photosensitive drums onto the intermediate transfer belt as a multiple transfer; the toner images of different colors, which have been transferred and layered on the intermediate transfer belt, are collectively transferred to a recording sheet; and the toner images on the recording sheet are fixed onto the recording sheet by a fixer heating and pressing the toner images.

Once the power is turned on, the above image formation apparatus normally executes a preparation operation until it shifts to a ready state in which image formation is executable.

The preparation operation includes, for example, a warm-up for increasing the temperature of the fixer to a temperature required to perform the fixing (a target temperature), and image stabilization control such as color registration correction.

The warm-up is to increase temperatures of a fixing roller and a pressure roller provided in the fixer by, while heating a heater of the fixer, rotating the fixing roller and the pressure roller at a constant speed with use of a fixing motor, such that the heat from the fixing heater is transferred all over the fixing roller and the pressure roller.

The color registration correction is to (i) form a registration pattern for each color on the intermediate transfer belt, while rotating the intermediate transfer belt at a constant speed with use of a main motor, (ii) detect positions of the formed registration patterns with use of a sensor or the like, (iii) calculate an amount of position shift of each color with reference to the detected positions of the registration patterns, and (iv) when performing image formation next time, correct an image write position of each color in accordance with the amount of position shift of each color.

Upon completion of the preparation operation such as the warm-up and the image stabilization control, the image formation apparatus shifts to the ready state. Hence, the longer it takes to complete the preparation operation, the more delayed the shift to the ready state. The more delayed the shift to the ready state, the longer a user has to wait. It is thereby desirable to complete the preparation operation as promptly as possible.

One method to complete the preparation operation as promptly as possible is to, for example, rapidly accelerate a motor used for a process of the preparation operation by initiating the motor with a high voltage applied thereto (hereinafter, referred to as "a high-speed initiation"). This way, the motor is promptly initiated, thus reducing a time period from the initiation until the motor is stabilized to rotate at a constant speed.

With respect to the color registration correction, the photosensitive drums and the intermediate transfer belt need to be stabilized to rotate at a constant speed at the time of forming the registration pattern for each color. Accordingly, if it takes time to stabilize the photosensitive drums and the intermediate transfer belt to rotate at a constant speed, the following disadvantages will follow: time of forming each registration pattern is delayed; time of executing the subsequent pattern detection and calculating the amount of position shift of each color is delayed; and completion of the color registration correction is delayed.

Meanwhile, with respect to the warm-up, it takes time to rotate the fixing roller and the pressure roller at a required rotation frequency. This extends a time period required between a start and completion of the warm-up.

Therefore, if the main motor and the fixing motor are initiated at the same time by the high-speed initiation, the color registration correction and the warm-up can be executed in parallel in a short amount of time.

However, execution of the high-speed initiation increases a peak value of a supplied power compared to execution of the normal initiation. Thus, in order to cause the high-speed initiation of the two motors at the same time, a power unit needs to have a significantly larger capacitance, which will lead to a cost increase. Moreover, the image formation apparatus needs to comply with its rated power consumption. Accordingly, if the capacitance of each motor is significantly increased, then it will be necessary to suppress an amount of power supplied to constituent elements other than the motors, so as to maintain the total power consumption equal to or below the rated power consumption.

One method to cause the high-speed initiation of the two motors while suppressing power consumption is to cause the high-speed initiation of the two motors at different timings. This method requires a less amount of power than an amount of power required to cause the high-speed initiation of the two motors at the same time. However, when a plurality of preparation processes including the warm-up and the color registration correction are executed in parallel—e.g., when the main motor is initiated by the high-speed initiation to start the color registration correction during the warm-up (while the fixing motor is being driven), the power supplied during the high-speed initiation of the main motor is added to the power supplied to the fixing motor. This will increase a peak value of the total power consumption, with the result that the power unit is forced to have a larger capacitance.

To simply suppress the capacitance, the color registration correction could be started, for example, after completion of the warm-up. This way, a peak value of the total power consumption can be suppressed because other motors are not driven at the time of initiating the main motor by the high-speed initiation. This, however, is not parallel processing; therefore, it takes a large amount of time to complete the preparation process.

Such a problem could occur not only in a case where a plurality of motors are driven but also in a case where only one motor is driven—e.g., in a case where the high-speed initiation of the main motor and supply of power to the fixing heater are executed at the same time immediately after the power-on. In this case, as the power supplied for the high-speed initiation is added to the power supplied to the fixing heater, the power unit needs to have a larger capacitance.

SUMMARY OF THE INVENTION

An object of the present invention is to provide an image formation apparatus and a preparation operation execution method for completing the preparation operation in a shorter amount of time while preventing a cost increase.

In order to achieve the aforementioned object, one aspect of the present invention is an image formation apparatus that includes at least one motor, executes a preparation operation including a plurality of different processes, and upon completion of the preparation operation, shifts to a ready state in which an image formation operation is executable, the plurality of different processes including at least one process that is executed by driving a corresponding motor of the at least one motor, the image formation apparatus comprising: an obtainer operable to obtain, for each of the different processes, an estimated time period required between a start and completion of the process; and a controller operable to start execution of, out of the different processes, (i) a process whose estimated time period is longer than the estimated time period of any other process, and thereafter, (ii) the any other process so that the any other process is executed in parallel with the process that has been started, wherein when the process to be started first is included in the at least one process, the controller initiates the corresponding motor by a high-speed initiation by applying thereto a first voltage that is higher than a second voltage, and when the any other process is included in the at least one process, the controller initiates the corresponding motor by a normal initiation by applying thereto the second voltage.

In order to achieve the aforementioned object, another aspect of the present invention is an image formation apparatus that executes a preparation operation including a first process and a second process, and upon completion of the preparation operation, shifts to a ready state in which an image formation operation is executable, the image formation apparatus comprising: an image former operable to form an image on an image carrier that is rotated by a motor, and transfer the formed image onto a sheet that is conveyed; a fixer operable to fix the transferred image onto the sheet by heat while causing a fixing member to convey the sheet, the fixing member being heated by a heater; a driver operable to drive and rotate the motor by switching between a normal initiation and a high-speed initiation, the normal initiation initiating the motor by applying thereto a first voltage, and the high-speed initiation initiating the motor by applying thereto a second voltage that is higher than the first voltage; an obtainer operable to obtain, for each of the first process and the second process, an estimated time period required between a start and completion of the process, the first process being executed by causing the motor to rotate the image carrier, and the second process being executed by causing the heater to heat the fixing member; and a controller operable to start execution of, out of the first process and the second process, (i) a process whose estimated time period is longer than the estimated time period of another process, and thereafter, (ii) the other process so that the other process is executed in parallel with the process that has been started, wherein the controller initiates the motor by (i) the high-speed initiation when the first process is the process to be started first, and (ii) the normal initiation when the first process is the other process to be started second, and the controller performs same electric power supply control on the heater, whether the second process is the process to be started first or the other process to be started second.

In order to achieve the aforementioned object, yet another aspect of the present invention is a preparation operation execution method used in an image formation apparatus that includes at least one motor, executes a preparation operation including a plurality of different processes, and upon completion of the preparation operation, shifts to a ready state in which an image formation operation is executable, the plurality of different processes including at least one process that is executed by driving a corresponding motor of the at least one motor, the preparation operation execution method comprising: an obtaining step for obtaining, for each of the different processes, an estimated time period required between a start and completion of the process; and a controlling step for starting execution of, out of the different processes, (i) a process whose estimated time period is longer than the estimated time period of any other process, and thereafter, (ii) the any other process so that the any other process is executed in parallel with the process that has been started, wherein when the process to be started first is included in the at least one process, the controlling step initiates the corresponding motor by a high-speed initiation by applying thereto a first voltage that is higher than a second voltage, and when the any other process is included in the at least one process, the controlling step initiates the corresponding motor by a normal initiation by applying thereto the second voltage.

In order to achieve the aforementioned object, yet another aspect of the present invention is a preparation operation execution method used in an image formation apparatus that executes a preparation operation including a first process and a second process, and upon completion of the preparation operation, shifts to a ready state in which an image formation operation is executable, wherein: the image formation apparatus includes (i) an image former operable to form an image on an image carrier that is rotated by a motor, and transfer the formed image onto a sheet that is conveyed and (ii) a fixer operable to fix the transferred image onto the sheet by heat while causing a fixing member to convey the sheet, the fixing member being heated by a heater; the first process is executed by causing the motor to rotate the image carrier, and the second process is executed by causing the heater to heat the fixing member; the preparation operation execution method includes (i) an obtaining step for obtaining, for each of the first process and the second process, an estimated time period required between a start and completion of the process and (ii) a controlling step for starting execution of, out of the first process and the second process, (a) a process whose estimated time period is longer than the estimated time period of another process, and thereafter, (b) the other process so that the other process is executed in parallel with the process that has been started; the controlling step initiates the motor by (i) a high-speed initiation by applying thereto a first voltage, which is higher than a second voltage, when the first process is the process to be started first, and (ii) a normal initiation by applying thereto the second voltage when the first process is the other process to be started second; and the controlling step performs same electric power supply control on the heater, whether the second process is the process to be started first or the other process to be started second.

In a case where the most time-consuming process is executed with use of a motor, the above structures allow (i) starting such process first by causing the high-speed initiation of the motor, and thereafter, (ii) in parallel with the high-speed initiation of the motor, causing the normal initiation of another motor used for another process. This prevents increase of a peak value of the power consumption during the preparation operation, and can reduce an amount of time required between the start and completion of the preparation operation.

BRIEF DESCRIPTION OF THE DRAWINGS

These and other objects, advantages and features of the invention will become apparent from the following description thereof taken in conjunction with the accompanying drawings, which illustrate a specific embodiment of the present invention.

In the drawings.

DESCRIPTION OF PREFERRED EMBODIMENTS

The following describes exemplary cases where embodiments of an image formation apparatus pertaining to the present invention are applied to a tandem digital color printer (hereinafter, simply referred to as "printer").

Embodiment 1

Figure 1:
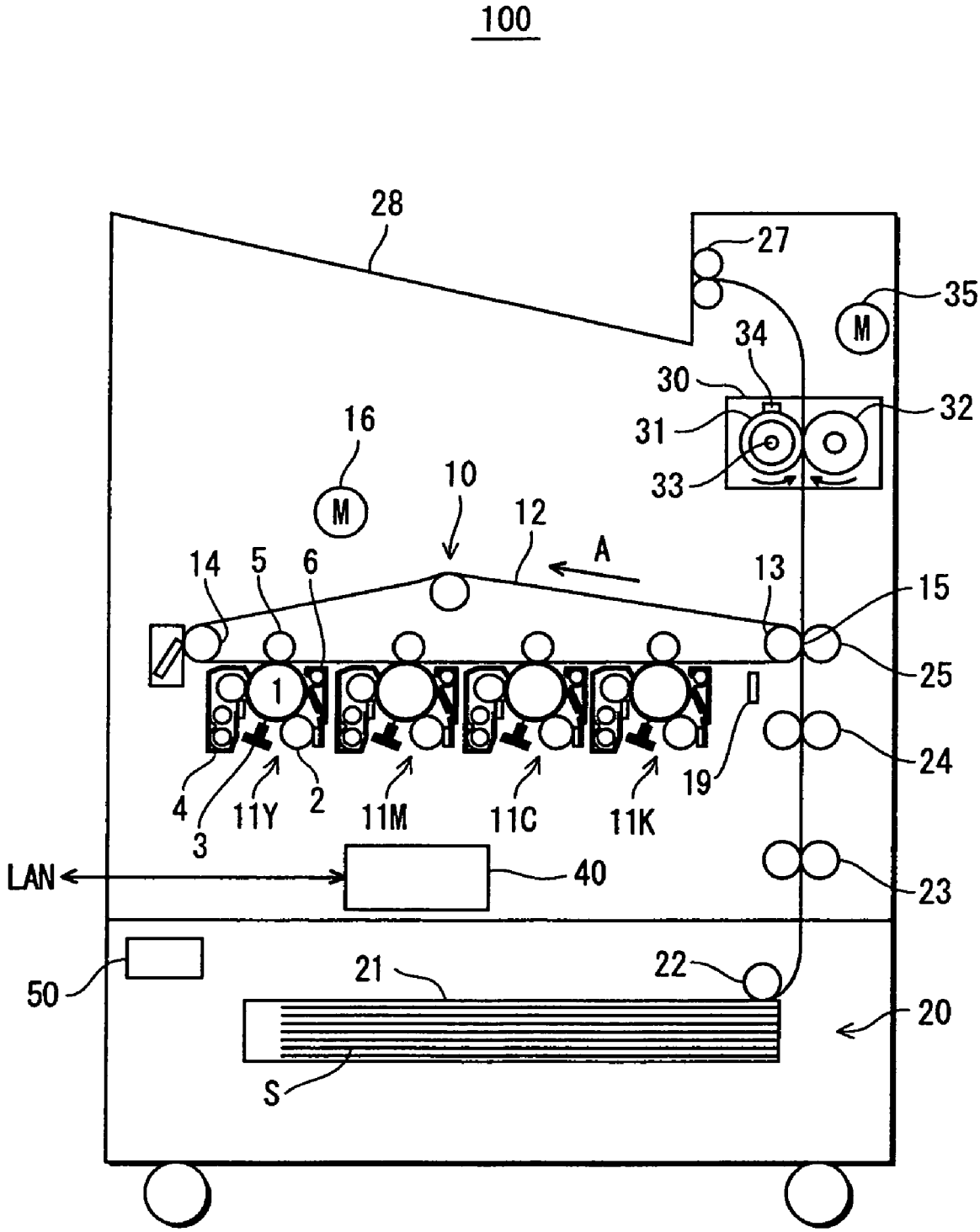
FIG. 1 shows an overall structure of a printer pertaining to Embodiment 1.

As shown in FIG. 1, the printer 100 is composed of: an image former 10; a feeder 20; a fixer 30; a controller 40; a power substrate 50; and so on. The printer 100 is connected to a network (in the present case, LAN). Upon receiving a print instruction from an external terminal apparatus (not illustrated), the printer 100 executes image formation in color in accordance with the instruction.

The image former 10 is composed of: image forming units 11Y, 11M, 11C and 11K corresponding to the colors yellow (Y), magenta (M), cyan (C) and black (K), respectively; an intermediate transfer belt 12; and so on.

The intermediate transfer belt 12 is suspended in a tensioned state on a driving roller 13, a driven roller 14, etc., and is driven to rotate in the direction of arrow A.

The image forming units 11Y to 11K are tandemly arranged to face the intermediate transfer belt 12 at predetermined intervals, so that they form a line from upstream to down stream in the direction of belt rotation. The image forming unit 11Y is composed of: a photosensitive drum 1Y that serves as an image carrier; a charger 2; an exposure unit 3; a developer 4; a primary transfer roller 5 facing the photosensitive drum 1Y with the intermediate transfer belt 12 sandwiched between the primary transfer roller 5 and the photosensitive drum 1Y; a cleaner 6; and so on. The charger 2, the exposure unit 3, the developer 4, the primary transfer roller 5, and the cleaner 6 are all disposed surrounding the photosensitive drum 1. Other image forming units 11M to 11K have the same structure as the image forming unit 11Y, and reference numbers thereof are omitted in FIG. 1. The letters Y, M, C and K (reproduction colors) are hereinafter appended to reference numbers of constituent elements of the image forming units, so as to distinguish between reproduction colors with which the constituent elements are associated.

The feeder 20 is composed of: a paper feed cassette 21 that contains a sheet S; a pickup roller 22 that picks up the sheet S of the paper feed cassette 21 one sheet at a time; a pair of conveyance rollers 23 for conveying the sheet S that has been picked up; a pair of timing rollers 24 for adjusting a timing to send the sheet S to a secondary transfer position 15; a secondary transfer roller 25 that is, in the secondary transfer position 15, pressed against the driving roller 13 with the intermediate transfer belt 12 sandwiched between the secondary transfer roller 25 and the driving roller 13; and the like.

The fixer 30 is composed of; a cylindrical fixing roller 31; a pressure roller 32 to be pressed against the fixing roller 31; a fixing heater 33 inserted in the fixing roller 31; a temperature detection sensor 34 for detecting a roller surface temperature of the fixing roller 31; a direct-current fixing motor 35 for driving and rotating the fixing roller 31 and the pressure roller 32; and so on.

Upon receiving the print instruction from the external terminal apparatus, the controller 40 (i) receives an image signal transmitted thereto, (ii) converts the image signal into digital image signals for colors Y to K, and (ii) causes execution of a print operation by controlling the image former 10, the feeder 20, the fixer 30, and the like.

More specifically, after the cleaners 6Y to 6K have removed toners left on surfaces of the photosensitive drums 1Y to 1K of the image forming units 11Y to 11K, the chargers 2Y to 2K uniformly charge the photosensitive drums 1Y to 1K. By the uniformly charged photosensitive drums 1Y to 1K being exposed to laser beams emitted by the exposure units 3Y to 3K, electrostatic latent images are formed on the surfaces of the photosensitive drums 1Y to 1K.

The electrostatic latent images are developed by the developers 4Y to 4K. As a result, toner images of colors Y to K are formed on the surfaces of the photosensitive drums 1Y to 1K, respectively. These toner images are sequentially transferred onto the rotating intermediate transfer belt 12 in their transfer positions (primary transfer), by electrostatic power acting on the primary transfer rollers 5Y to 5K that are disposed on the inner side of the intermediate transfer belt 12. At this time, image formation operations for colors Y to K are executed at different timings; the toner images of colors Y to K are transferred onto the intermediate transfer belt 12 so that they are layered on top of each other in the same position on the intermediate transfer belt 12. Once the toner images of colors Y to K have been transferred to the intermediate transfer belt 12, they are conveyed to the secondary transfer position 15 by the rotation of the intermediate transfer belt 12.

Meanwhile, the sheet S is fed from the feeder 20 via the pair of timing rollers 24 in accordance with a rotation timing of the intermediate transfer belt 12. The sheet S is conveyed sandwiched between the rotating intermediate transfer belt 12 and the secondary transfer roller 25. The toner images on the intermediate transfer belt 12 are collectively transferred to the sheet S in the secondary transfer position 15 by electrostatic power acting on the secondary transfer roller 25 (secondary transfer).

Once the sheet S has passed the secondary transfer position 15, it is conveyed to the fixer 30. When the sheet S passes through an area pressed between the fixing roller 31 and the pressure roller 32 (fixing nip), the toner images are fixed onto the sheet S by heat and pressure. Thereafter, the sheet S is discharged to a discharge tray 28 via a pair of discharge rollers 27.

Note, rotating members other than the fixing roller 31 and the pressure roller 32—specifically, the photosensitive drums 1Y to 1K, the intermediate transfer belt 12, the pickup roller 22, the pair of timing rollers 24, etc.—are driven and rotated by receiving a driving force from a direct-current main motor 16.

The power substrate 50 supplies required power to constituent elements of the image formation apparatus such as the main motor 16, the fixing motor 35, the fixing heater 33, and the controller 40.

A pattern detection sensor 19 is disposed further downstream than the image forming units 11K in the direction of belt rotation, in such a manner that the pattern detection sensor 19 faces the intermediate transfer belt 12.

The pattern detection sensor 19 is a conventional reflective optical sensor comprising a light-emitting element and a light-receiving element. When color registration correction (described later) is executed as image stabilization control, the pattern detection sensor 19 detects registration patterns formed on the outer surface of the intermediate transfer belt 12, and transmits a result of the detection to the controller 40.

Figure 2:
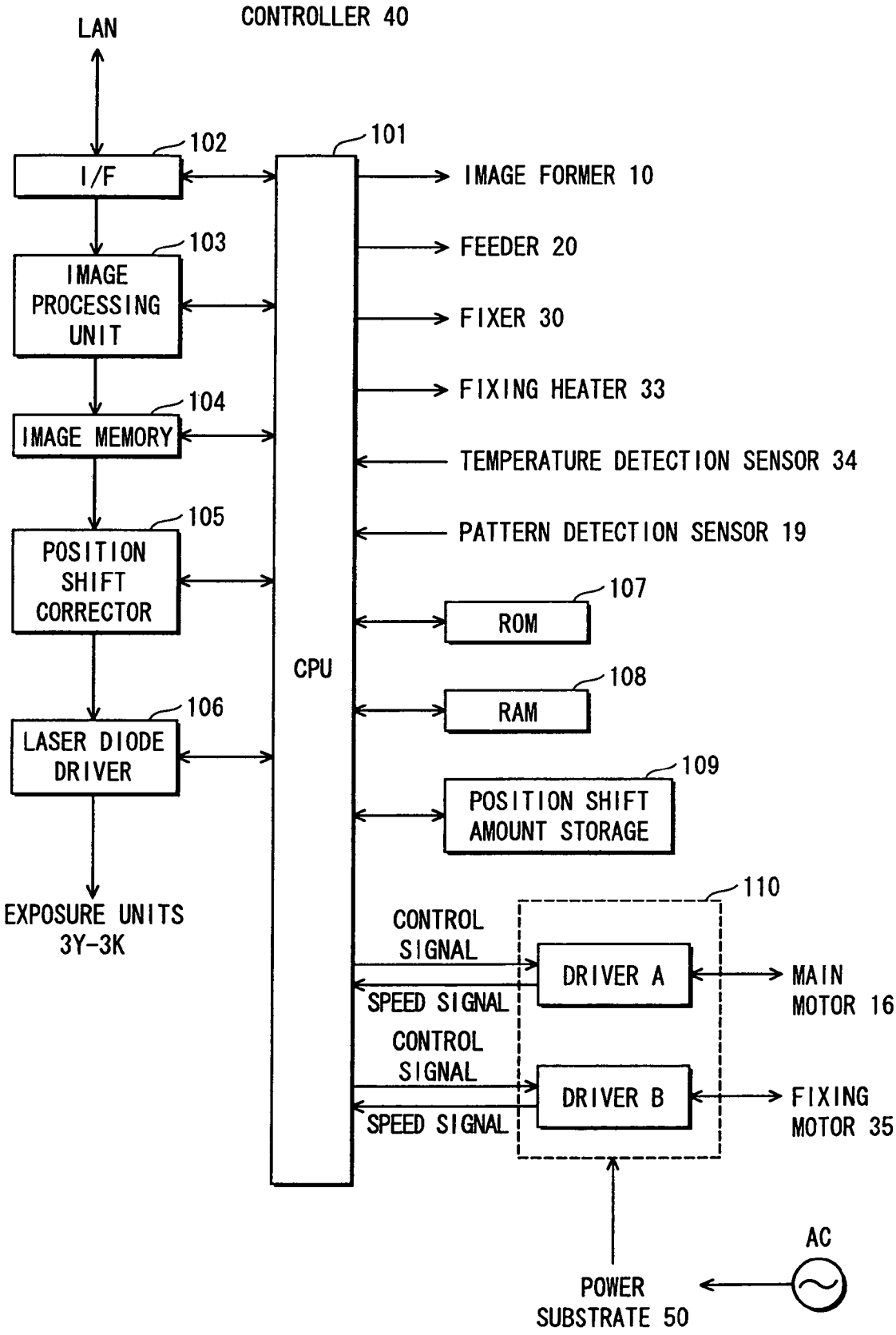
FIG. 2 shows the structure of a controller of the printer.

As shown in FIG. 2, major constituent elements of the controller 40 include: CPU 101; a communication interface (I/F) 102; an image processing unit 103; an image memory 104; a position shift corrector 105; a laser diode driver 106; ROM 107; RAM 108; position shift amount storage 109; and driver 110.

The communication I/F 102 is an interface (e.g., a LAN card and a LAN board) for connecting to LAN.

Upon receiving print job data from outside via the communication I/F 102, the image processing unit 103 (i) performs processing (e.g., conventional density correction) on the image, (ii) converts the print job data into image data for colors Y to K, and (iii) temporarily stores the converted image data into the image memory 104.

The position shift corrector 105 controls the image former 10 to execute color registration correction, which is to (i) form registration patterns on the intermediate transfer belt 12, and (ii) calculate an amount of position shift of each color. As a color registration correction method is conventionally known, a detailed description of the color registration correction is omitted. The following is a brief outline of the color registration correction.

Figure 3:
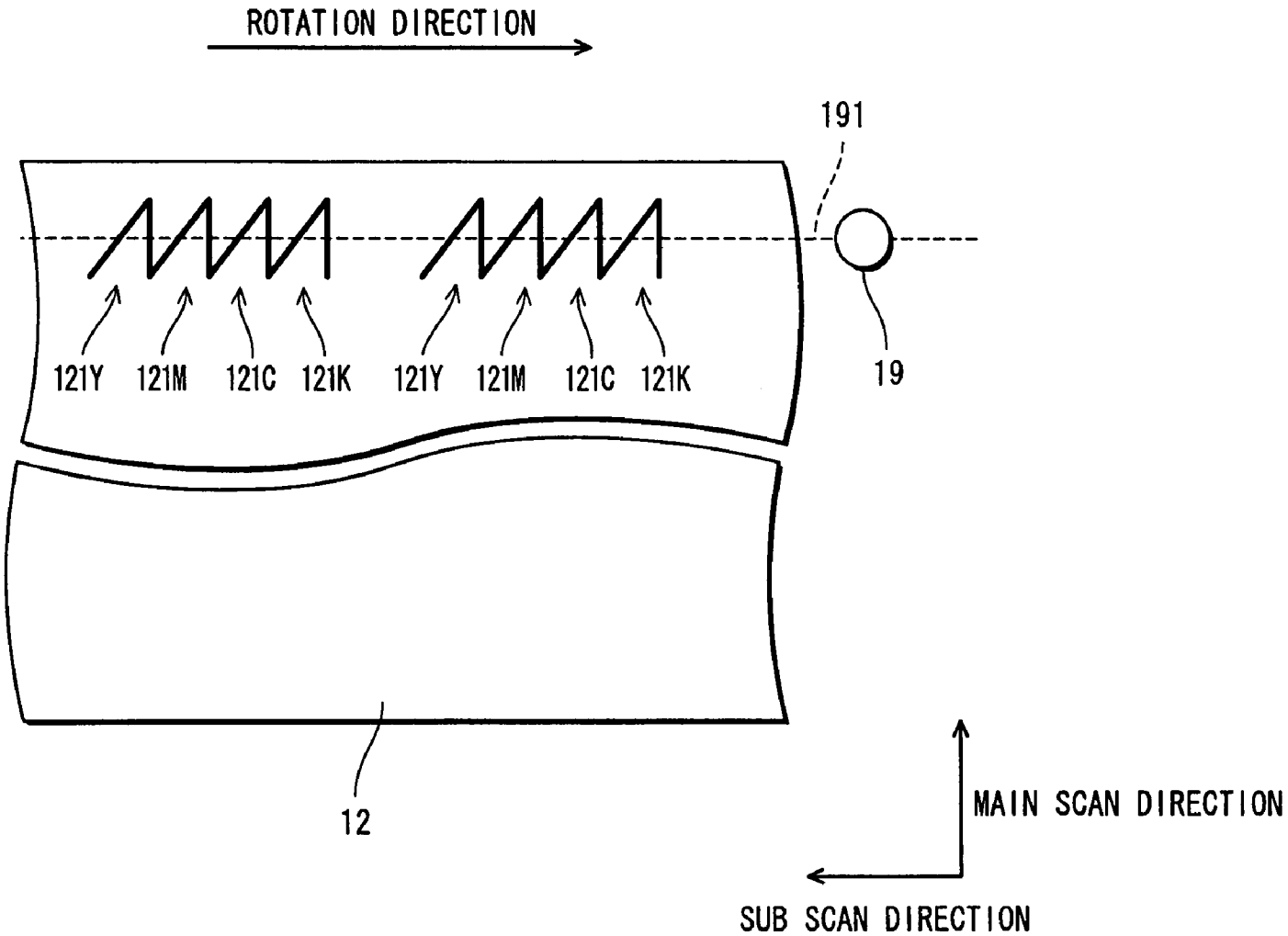
FIG. 3 exemplarily shows a registration pattern formed on an intermediate transfer belt for each color.

The intermediate transfer belt 12 is rotated by driving the main motor 16. As shown in FIG. 3, registration patterns 121Y to 121K of colors Y to K are formed on the intermediate transfer belt 12. Each of the registration patterns 121Y to 121K is a V-shaped pattern composed of a first straight line parallel to a main scan direction, and a second straight line that forms an angle of 45° between itself and the first straight line. When the position shift has not occurred, the registration patterns are supposed to be formed in such a manner that (i) their centers in the main scan direction are aligned, and (ii) they are lined up at predetermined intervals in a sub scan direction. Each of the formed registration patterns is detected on a detection line (a dotted line 191 in FIG. 3) when passing a detection position due to the rotation of the intermediate transfer belt 12, the detection position being a position in which the pattern detection sensor 19 performs detection.

With reference to the position of a registration pattern for the color black, a distance between the registration pattern for the color black and a registration pattern for another color in the sub scan direction is calculated from a detection signal obtained as a result of the pattern detection sensor 19 detecting the registration patterns. Then, for each color, an amount of position shift in the sub scan direction is calculated, the amount of position shift indicating a difference between (i) a distance between a registration pattern that should be formed for the color black and a registration pattern that should be formed for another color in the sub scan direction when the position shift has not occurred, and (ii) the distance calculated from the detection signal. Data of the position shift amount calculated for each color is stored in the position shift amount storage 109.

In accordance with the data of the calculated position shift amount for each color, which is stored in the position shift amount storage 109, the position shift corrector 105 eliminates the position shift in the sub scan direction by executing conventional write position correction, which is to correct, on a pixel-by-pixel basis, write positions in which the images of colors Y to K are written on the photosensitive drums 1Y to 1K by changing an address of the image data. This way, a color registration error can be prevented during color image formation.

One way to improve the accuracy of the position shift detection is to increase the number of registration patterns 121Y to 121K to be formed, and then to calculate an average of detection results. However, the more the number of registration patterns to be formed, the longer the time period between the start of writing the registration patterns and completion of detection of the registration patterns, i.e., the longer it takes to complete color registration correction.

In contrast, the smaller the number of registration patterns to be formed, the shorter the time period required between a start and completion of color registration correction; this, however, will decrease the detection accuracy to some extent. Nonetheless, the cause of a position shift, for example, expansion/contraction of a lens in an optical system due to a temperature change, does not always occur. Even when such a position shift has occurred, if it was minimal, it does not necessarily cause a color registration error visible to human eyes. Therefore, even if the number of registration patterns is small, deterioration in image quality does not necessarily occur.

In view of the above, the present embodiment aims to change the number of registration patterns to be formed when certain conditions are met. More specifically, upon the power-on, the number of registration patterns to be formed is (i) increased if a time period elapsed between a previous power-off and the present power-on is longer than a predetermined time period, and (ii) decreased if the elapsed time period is equal to or shorter than the predetermined time period. This is because when the elapsed time period (during which the power had been off) is short, it is expected that the state of the image formation apparatus has not changed to a great extent during the power-off time period. Therefore, a color registration error can be prevented by performing a simple color registration correction, in which the number of registration patterns to be formed is decreased. Note, the elapsed time period (the power-off time period) is measured by a timer (not illustrated) or the like. Hereinafter, color registration correction will be specifically referred to as "normal registration correction" when it is performed by forming a large number of registration patterns. As opposed to this, color registration correction will be specifically referred to as "simple registration correction" when it is performed by forming a small number of registration patterns. Collectively, these color registration corrections will be referred to as "color registration correction".

Normal registration correction and simple registration correction may be switched between each other using other methods. For example, it is permissible to execute (i) normal registration correction when there is a large difference between (a) the temperature inside the image formation apparatus at the time of turning off the power previously and (b) the temperature inside the image formation apparatus at the time of turning on the power at present, and (ii) simple registration correction when such a temperature difference is small. Or, normal registration correction and simple registration correction may be switched between each other based on, for example, the accumulated number of printed sheets and accumulated driving time period.

Turning to FIG. 2, the laser diode driver 106 drives laser diodes of the exposure units 3Y to 3K in accordance with the image data corrected by the position shift corrector 105.

ROM 107 stores therein: a control program relating to an image formation operation performed by the image former 10 and the like; a control program relating to the after-mentioned preparation operation; data for printing registration patterns of colors Y to K; a program for correcting a position shift of an image; and so on.

RAM 108 is used as a work area for CPU 101.

CPU 101 (i) receives a detection signal from the temperature detection sensor 34, (ii) detects a surface temperature of the fixing roller 31, and (iii) controls power supplied to the fixing heater 33 so as to maintain the surface temperature of the fixing roller 31 at a temperature required between a start and completion of the fixing (i.e., a target temperature). CPU 101 also receives inputs from various sensors such as the pattern detection sensor 19, and reads out necessary programs from ROM 107. Furthermore, CPU 101 causes smooth print operations by either (i) controlling (a) data processing in the image processing unit 103, (b) read-in and read-out of image data in the image memory 104, and (c) details of image data correction executed in the position shift corrector 105, and (ii) collectively controlling operations of the image former 10, the feeder 20, the fixer 30, etc. at proper timings. Furthermore, CPU 101 controls the main motor 16 and the fixing motor 35 via the driver 110, so that the rotation speed of the main motor 16 and the fixing motor 35 is maintained at a target speed.

The driver 110 includes drivers A and B for driving and rotating the main motor 16 and the fixing motor 35, respectively. While receiving power from the power substrate 50, the driver A supplies power to the main motor 16 in accordance with a control signal transmitted from CPU 101, so that the main motor 16 rotates at a rotation frequency indicated by the control signal. The driver A also receives a speed signal from the main motor 16, and transmits this speed signal to CPU 101. CPU 101 acknowledges a current rotation speed of the main motor 16 from the received speed signal. When the current rotation speed of the main motor 16 is not the same as the target speed, CPU 101 transmits a control signal to the driver A so that the main motor 16 rotates at the target speed.

The same goes for the driver B. While receiving power from the power substrate 50, the driver B supplies power to the fixing motor 35 in accordance with a control signal transmitted from CPU 101, so that the fixing motor 35 rotates at a rotation frequency indicated by the control signal. The driver B receives a speed signal from the fixing motor 35, and transmits this speed signal to CPU 101. Based on the received speed signal, CPU 101 transmits a control signal to the driver B so that the fixing motor 35 rotates at a target speed.

As shown in FIGS. 4A and 4B, the voltage of the control signal is correlated with the rotation speed as follows: as the voltage of the control signal is increased, a larger amount of power is supplied to a direct-current motor, thereby accelerating the rotation speed. Contrarily, as the voltage of the control signal is decreased, the rotation speed slows down. The following describes control of the main motor 16. Although the description of the fixing motor 35 is omitted, the fixing motor 35 is controlled fundamentally in the same manner as the main motor 16.

As shown in FIGS. 4A and 4B, once CPU 101 outputs an initiation voltage V1 (being of a constant value) as a control signal to the driver A, power is supplied to the main motor 16 which is a direct-current motor. This causes the main motor 16 to start rotating while accelerating its rotation speed. CPU 101 monitors a current rotation speed of the main motor 16. When the rotation speed of the main motor 16 reaches a control alteration speed Vs (e.g., a rotation speed that is equivalent to 90% of the target speed), CPU 101 performs variable control, which is for changing the voltage of the control signal so that the rotation speed of the main motor 16 is maintained at the target speed.

More specifically, the initiation voltage V1 is switched to a voltage having a pulsed waveform, which is slightly lowered when the rotation speed of the main motor 16 is faster than the target speed, and slightly increased when the rotation speed of the main motor 16 is slower than the target speed. Hereinafter, "motor initiation" implies a time period between (i) the start of rotation and (ii) the time at which the rotation speed reaches the control alteration speed Vs. "Acceleration control" implies rotation control performed upon the motor initiation. "Feedback control" implies rotation control performed after completion of the motor initiation.

As is obvious from changes in the rotation speed, acceleration of the main motor 16 does not instantly hit zero upon completion of the acceleration control. The rotation speed slows down shortly after it exceeds the target speed. Afterward, the rotation speed is maintained at the target speed due to repetition of the following processes: (i) slightly accelerating the rotation speed when it is slower than the target speed; and (ii) slightly slowing down the rotation speed when it has exceeded the target speed.

As depicted in FIG. 4A, the rotation speed is stabilized when a time period Ta has elapsed since the initiation (i.e., when the rotation speed is accelerated and exceeds the target speed for the second time, after the rotation speed (i) exceeded the target speed for the first time and (ii) slowed down and fell below the target speed). FIG. 4A shows an exemplary case where it takes a while to stabilize the rotation speed because the voltage V1 of the control signal is set low at the time of initiation.

Figure 4:
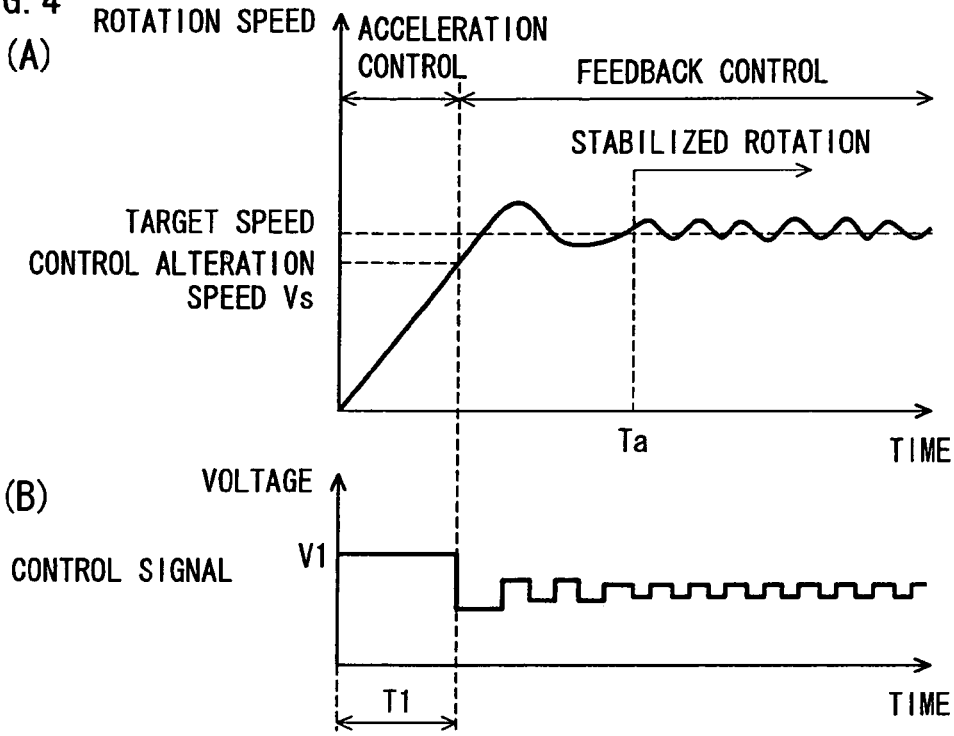
FIG. 4A shows how a rotation speed of a main motor and a fixing motor changes when rotations of the main motor and the fixing motor are controlled.
FIG. 4B shows how voltage of a control signal changes when rotations of the main motor and the fixing motor are controlled.
Figure 5:
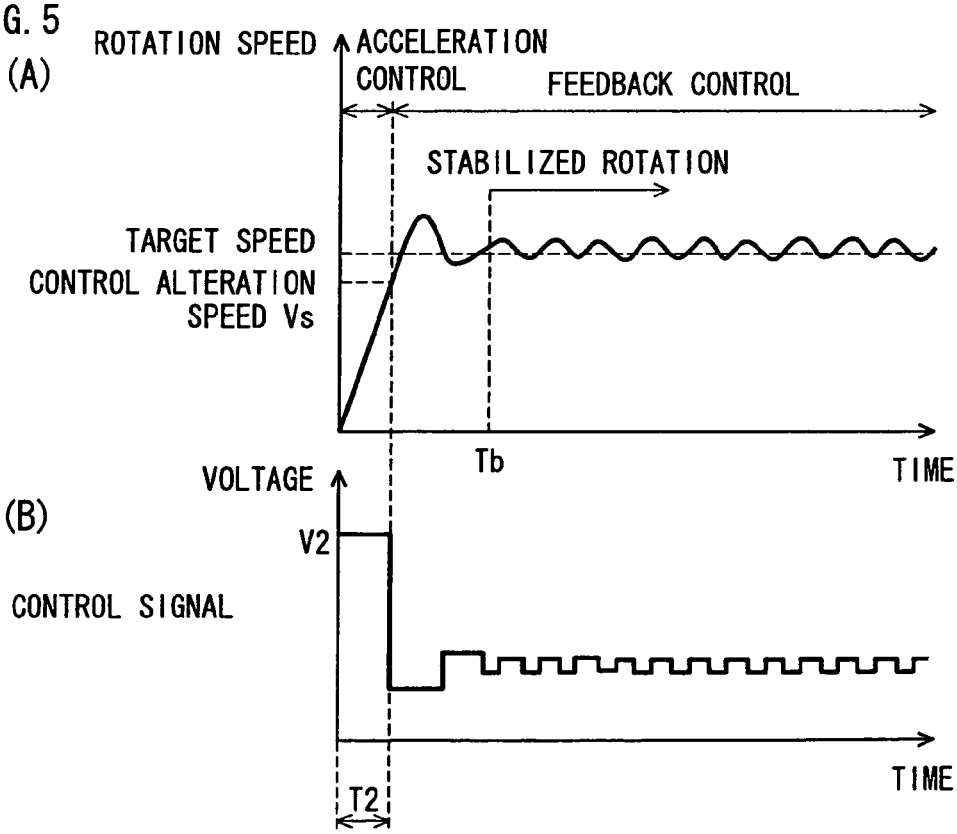
FIGS. 5A and 5B show how the motor rotation control is performed when the initiation voltage of the control signals transmitted to the main motor and the fixing motor is set at V2, which is higher than V1.
Figure 6:
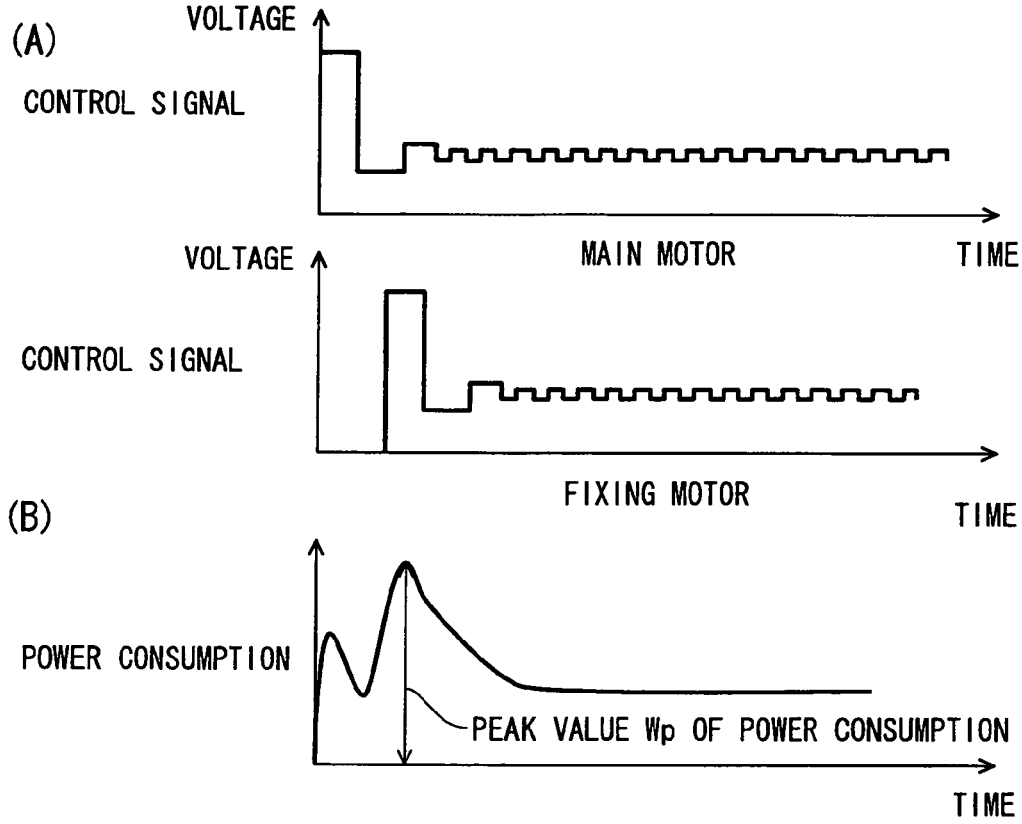
FIG. 6A shows exemplary waveforms of control signals that are output from CPU when initiating the main motor and the fixing motor by high-speed initiation at different timings.
FIG. 6B shows an exemplary waveform of power obtained by adding power consumption of the main motor and power consumption of the fixing motor (total power consumption)
Figure 7:
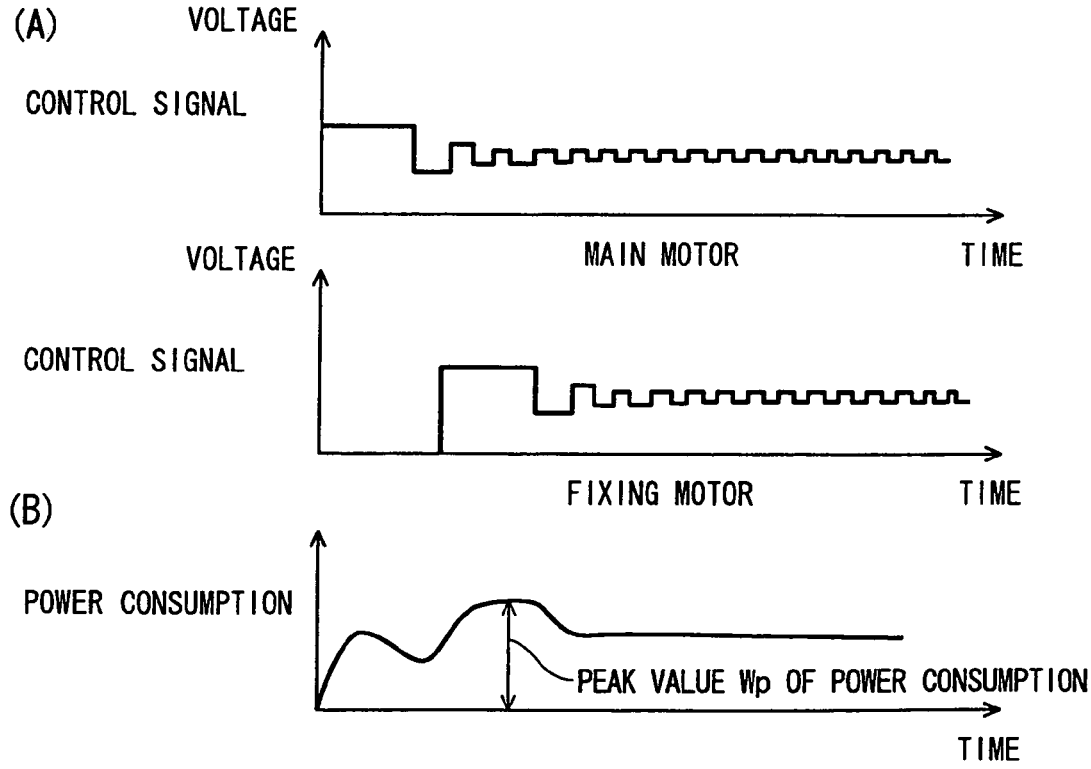
FIG. 7A shows exemplary waveforms of control signals transmitted when initiating the main motor and the fixing motor by normal initiation.
FIG. 7B shows an exemplary waveform of the total power consumption of the main motor and the fixing motor.

As shown in the example of FIGS. 5A and 5B, in a case where an initiation voltage of a control signal is set at V2 that is higher than V1 (in FIG. 5B, V2 is twice as high as V1), a time period T2 is shorter than a time period T1 shown in FIG. 4B (in FIG. 5B, T2 is half the length of T1), the time periods T1 and T2 each being a time period from the initiation to the time at which the rotation speed reaches the control alteration speed Vs. Accordingly, a time period Tb required to stabilize the rotation speed is significantly shorter than the time period Ta shown in FIG. 4A.

Meanwhile, although not illustrated, because the initiation voltage V2 is higher than the initiation voltage V1 shown in FIG. 4, the amount of power supplied to the main motor 16 is large. Consequently, the power consumption peak during the acceleration control of FIG. 5B is higher than that of FIG. 4B. That is to say, a time period from the initiation of the main motor 16 to stabilization of its rotation speed is traded-off against power consumed during such a time period.

Hereinafter, "high-speed initiation" implies initiating a motor by instantly supplying thereto a large amount of power, with the initiation voltage of a control signal set at V2. In contrast, "normal initiation" implies initiating a motor by supplying thereto a less amount of power than the amount of power supplied during the high-speed initiation, with the initiation voltage of a control signal set at V1 that is lower than V2.

In the present embodiment, as will be described later, a judgment is made, for each of the main motor 16 and the fixing motor 35, as to which one of the normal initiation and the high-speed initiation should be used in initiating the motors. Each motor is initiated using the initiation method determined by this judgment.

Turning to FIG. 2, when the power is turned on, CPU 101 executes color registration correction and a warm-up for the fixer 30 as processes included in the preparation operation. Once the color registration correction and the warm-up have been completed, the image formation apparatus is in a printable state (ready state). Here, the warm-up is a process for increasing the temperature of the fixer 30 to the target temperature by, while supplying power to the fixing heater 33 and thereby heating the fixing heater 33, driving the fixing motor 35 to rotate the fixing roller 31 and the pressure roller 32, so that the heat from the fixing heater 33 is transferred all over the fixing roller 31 and the pressure roller 32.

A time period required between a start and completion of the warm-up greatly varies depending on the temperature of the fixer 30 at the time of starting the warm-up. That is to say, when the temperature of the fixer 30 at the time of starting the warm-up is somewhat high, it does not take much time to increase the temperature of the fixer 30 to the target temperature. However, when the temperature of the fixer 30 at the time of starting the warm-up is just about room temperature, it takes time to increase the temperature of the fixer 30 to the target temperature because of a larger temperature difference between the temperature of the fixer 30 and the target temperature. Likewise, a time period required between a start and completion of a process of color registration correction also varies, the color registration correction including the normal registration correction and the simple registration correction as described earlier.

As mentioned in the "BACKGROUND OF THE INVENTION" section above, processes included in the preparation operation, such as the color registration correction and the warm-up, are desirably completed as promptly as possible. One method to do so is to cause the high-speed initiation of both of the main motor 16 and the fixing motor 35. This, however, is problematic in that use of this method requires a motor to have a large capacitance. Below, this problem will be specifically described with reference to FIGS. 6A through 7B.

As shown in FIGS. 6A and 6B, in a case where the main motor 16 is initiated first by the high-speed initiation and the fixing motor 35 is initiated by the high-speed initiation immediately after completion of the high-speed initiation of the main motor 16, the highest peak value Wp of the total power consumption appears during the high-speed initiation of the fixing motor 35. That is to say, when the fixing motor 35 is initiated by the high-speed initiation while performing feedback control over the main motor 16, power consumed for the high-speed initiation of the fixing motor 35 is added to power consumed for the main motor 16, thereby increasing the peak value Wp. It should be mentioned that the peak value Wp would be much larger if both of the main motor 16 and the fixing motor 35 were initiated by the high-speed initiation at the same time.

Meanwhile, as shown in FIGS. 7A and 7B, when the main motor 16 and the fixing motor 35 are initiated by the normal initiation, the highest peak value Wp of the total power consumption appears during the normal initiation of the fixing motor 35. However, the peak value Wp shown in FIG. 7B is small compared to the peak value Wp associated with the high-speed initiation shown in FIG. 6B. In examples of FIGS. 7B and 6B, the peak value Wp shown in FIG. 7B is about half of the peak value Wp shown in FIG. 6B.

As set forth above, use of the normal initiation can reduce the capacitance of a motor, but extends a time period required to stabilize the rotation speed of the motor, and accordingly, a time period required between a start and completion of the preparation operation.

In view of the above, the present embodiment is configured to (i) first rotate, by the high-speed initiation, a motor used for a time-consuming process, and (ii) upon completion of this initiation, rotate another motor used for a process that does not take much time. With these processes executed in parallel, the capacitance of each motor can be reduced, and the preparation operation can be performed in a shorter amount of time. This enables the image formation apparatus to shift to the ready state more promptly.

Figure 8:
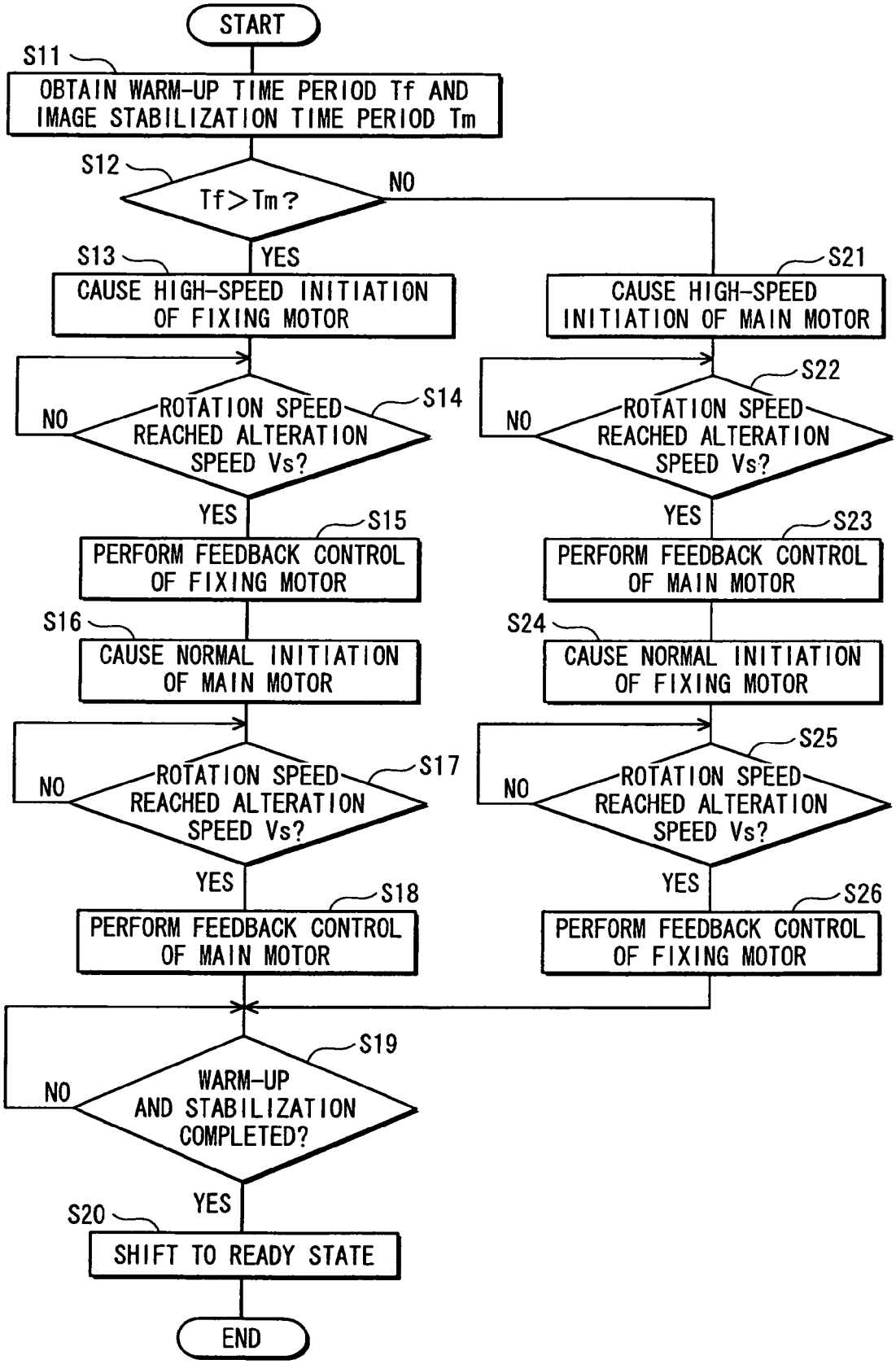
FIG. 8 is a flowchart showing details of motor rotation control that is performed during a preparation operation.
Figure 9:
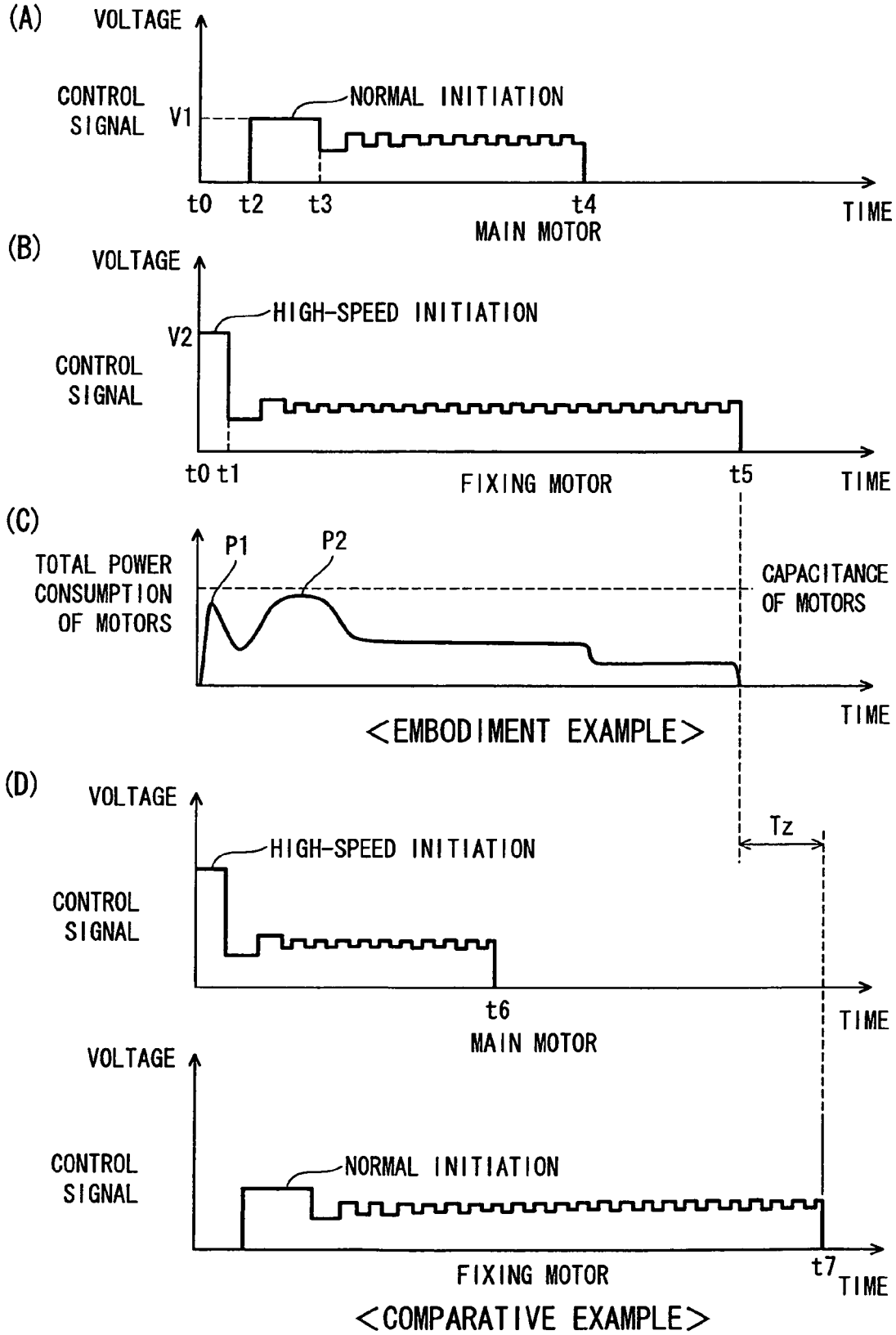
FIGS. 9A to 9C show changes in (i) voltage waveforms of control signals that are output from CPU during the preparation operation, and (ii) the total power consumption of the main motor and the fixing motor, pertaining to Embodiment 1 (an embodiment example)
FIG. 9D shows changes in voltage waveforms of control signals that are output from CPU during the preparation operation in a comparative example.
Figure 10:
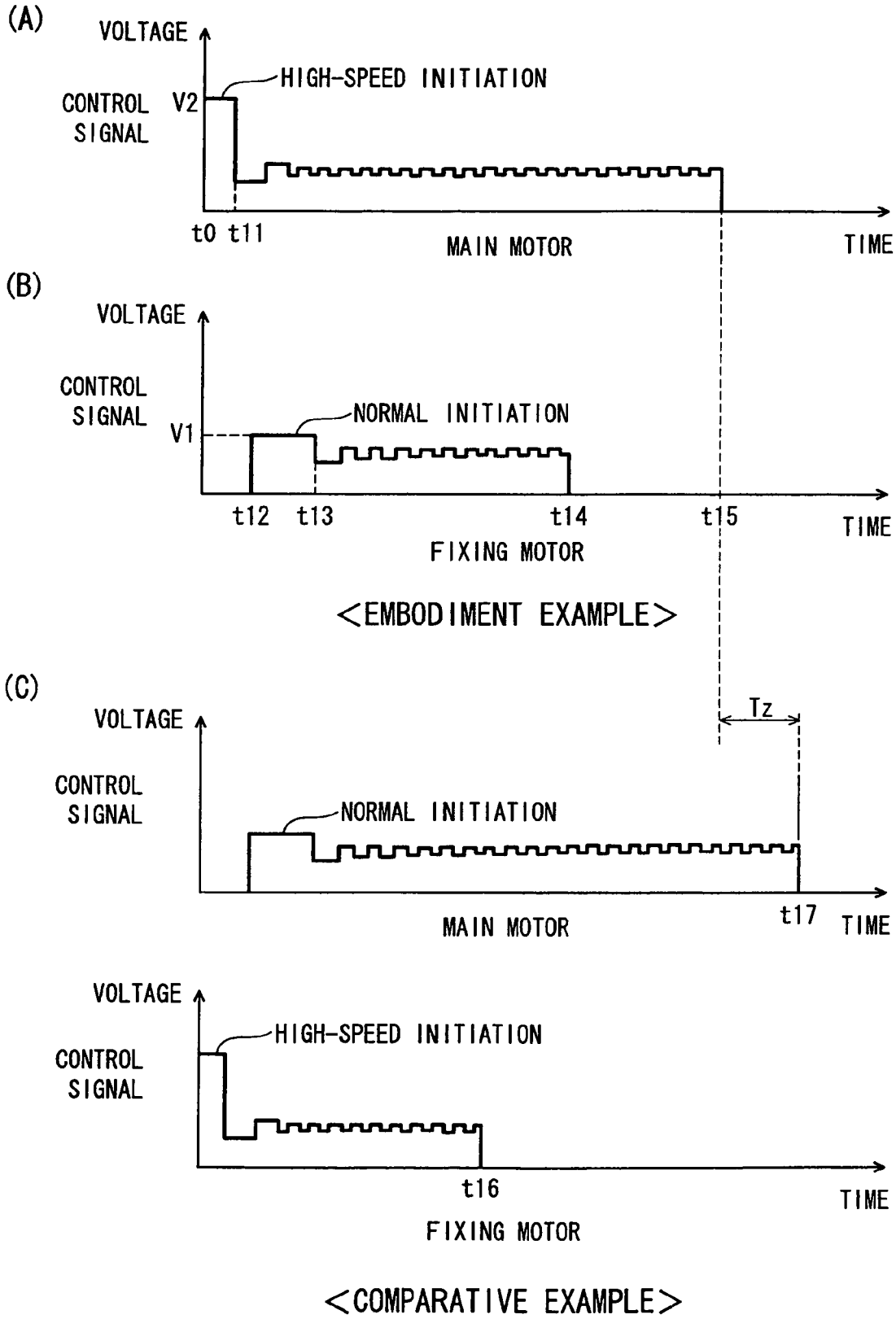
FIGS. 10A and 10B exemplarily show changes in voltage waveforms of other control signals that are output from CPU during the preparation operation in Embodiment 1 (the embodiment example)
FIG. 10C exemplarily shows changes in other voltage waveforms of control signals that are output from CPU during the preparation operation in a comparative example.

Described below, with reference to FIGS. 8 to 10C, is the details of motor rotation control. Note, the motor rotation control shown in FIG. 8 is executed when the power is turned on.

As shown in FIG. 8, CPU 101 obtains a time period Tf, which is estimated to be required between a start and completion of the warm-up, and a time period Tm, which is estimated to be required between a start and completion of the color registration correction (Step S11). Hereinafter, the time periods Tf and Tm may be referred to as a warm-up time period and an image stabilization time period, respectively. The warm-up time period Tf is obtained by: (i) detecting a current roller surface temperature of the fixing roller 31 in accordance with the detection signal from the temperature detection sensor 34; and (ii) obtaining information indicating a time period (equivalent to the time period Tf) required to increase the roller surface temperatures of each of the fixing roller 31 and the pressure roller 32 from the detected roller surface temperature to the target temperature.

Said time period has been obtained in advance from experiments or the like, and is estimated to be required to increase the roller surface temperature of each of the fixing roller 31 and the pressure roller 32 from the detected roller surface temperature to the target temperature, by rotating the fixing roller 31 and the pressure roller 32 with the fixing heater 33 turned on, so that the heat from the fixing heater 33 is transferred all over the fixing roller 31 and the pressure roller 32. For example, said time period may be obtained by reading out, from ROM 107, information such as a table indicating roller surface temperatures and estimated time periods in one-to-one correspondence.

Said time period may be obtained using other methods including the following. First, CPU 101 obtains a time period Ts1 for which the fixing heater 33 has to be on to increase the temperature of the fixing roller 31 by one. [C°]. Then, CPU 101 obtains a time period Ts2 that is estimated to elapse between (a) the time at which the roller surface temperature of the fixing roller 31 is detected to have reached the target temperature and (b) the time at which the heat has been transferred all over the fixing roller 31 and the pressure roller 32, in such a manner that both rollers have substantially the same temperature. Thereafter, CPU 101 obtains said time period by adding the time period Ts2 to a value obtained by multiplying the time period Ts1 by the difference between the roller surface temperature and the target temperature.

Meanwhile, the image stabilization time period Tm can be obtained depending on which one of the above-mentioned normal registration correction and simple registration correction is executed. Here, it is assumed that (i) for each of the normal registration correction and the simple registration correction, a time period that is expected to be required between a start and completion thereof has been obtained from experiments or the like, and (ii) each time period is stored in ROM 107 etc. This way, once the judgment is made as to which one of the color registration corrections should be executed, the image stabilization time period Tm can be obtained by reading out information indicating the time period associated with the color registration correction determined from the judgment.

When judged as "the time period Tf>the time period Tm" (YES of Step S12), the fixing motor 35, which is used for the time-consuming process, is initiated by the high-speed initiation (Step S13) (time t0 in FIG. 9B).

When it is judged that the rotation speed of the fixing motor 35 has reached the control alteration speed Vs (YES of Step S14), the acceleration control of the fixing motor 35 is switched to the feedback control (Step S15) (time t1 in FIG. 9B). This completes the high-speed initiation of the fixing motor 35. It should be noted that, although not illustrated in FIG. 8, the fixing heater 33 may be turned on immediately after the high-speed initiation of the fixing motor 35, or at the time of starting the high-speed initiation of the fixing motor 35, unless the total power consumption exceeds the rated power consumption of the image formation apparatus. The above warm-up time period Tf is obtained with the timing of turning on the fixing heater 33 taken into account.

With the heat of the fixing heater 33, rotation of the fixing motor 35 drives, rotates and heats the fixing roller 31 and the pressure roller 32.

In Step S16, the main motor 16, which is used for the process that does not take much time, is initiated by the normal initiation (time t2 in FIG. 9A). When it is judged that the rotation speed of the main motor 16 has reached the control alteration speed Vs (YES of Step S17), the acceleration control of the main motor 16 is switched to the feedback control (Step S18) (time t3 of FIG. 9A). This completes the normal initiation of the main motor 16. Although not illustrated in FIG. 8, the following are also performed: after the feedback control is started, once the rotation speed of the main motor 16 has been stabilized at the target speed (when a time period equivalent to the time period Ta of FIG. 4A has elapsed), registration patterns 121Y to 121K are formed; thereafter, the formed registration patterns 121Y to 121K are detected and an amount of position shift is calculated for each color.

In Step S19, a judgment is made as to whether or not both of the warm-up and the image stabilization operation have been completed. With respect to the warm-up, the judgment is made depending on whether or not a time period elapsed since the start of rotation of the fixing motor 35 has reached the warm-up time period Tf, which has been obtained in Step S11 above. When such an elapsed time period has reached the time period Tf, the current roller surface temperature should have reached the target temperature as well. However, if the current roller surface temperature has not reached the target temperature yet, the warm-up will be executed continuously.

As is the case with a warm-up, the color registration correction is executed depending on whether or not the time period Tm obtained in Step S11 has elapsed. However, if the operation of the color registration correction has been actually completed, then it is permissible to, regardless of the elapsed time period measured by the timer, judge that the color registration correction has been completed.

According to the example of FIGS. 9A and 9B, rotation of the main motor 16 stops first (time t4), then rotation of the fixing motor 35 stops next (time t5). In this example, a time period required between a start and completion of the whole preparation operation (from time t0 to time t5) is equivalent to a time period throughout which the fixing motor 35 is on, and is longer than a time period throughout which the main motor 16 is on. Thus, even when the color registration correction is parallelly executed during the warm-up, such parallel execution does not affect the time period required between the start and completion of the whole preparation operation (i.e., even when the warm-up and the color registration correction are executed in parallel, the color registration correction is completed by the time the warm-up is completed).

As shown in FIG. 9C, a peak P1 and a peak P2 of the total power consumption of the motors appear during the high-speed initiation of the fixing motor 35 (from time t0 to time t1) and during the normal initiation of the main motor 16 (from time t2 to time t3), respectively.

The peak P1 appears while the fixing motor 35 is being initiated by the high-speed initiation without the main motor 16 rotating yet. Consequently, even if the fixing motor 35 is initiated by the high-speed initiation, the value of the peak P1 is lower than the peak value Wp shown in FIG. 6B above, because none of other motors are active—i.e., there is no power consumption to be added to the total power consumption. On the other hand, the peak P2 appears due to adding the power consumed for the feedback control of the fixing motor 35 to the power consumed for the normal initiation of the main motor 16. The peak P2 is equivalent to the peak value Wp shown in FIG. 7B above. Although the value of the peak P2 is slightly larger than the value of the peak P1, the difference therebetween is small. In other words, the peaks P1 and P2 can be both maintained low. This makes it possible to use a power unit having a small capacitance. The amounts of power to be supplied to motors during the high-speed initiation and the normal initiation are set in advance, so that the total power consumption of the motors remains equal to or lower than a predetermined value (a dotted line) during each of the high-speed initiation and the normal initiation.

As set forth above, by executing the time-consuming process by the high-speed initiation and the processing that does not take much time by the normal initiation in listed order, the preparation operation can be promptly completed, and the capacitance of a motor can be reduced. If these processes are executed in reverse order, it will take a while to complete the preparation operation, as shown in the comparative example of FIG. 9D.

FIG. 9D shows an exemplary case where the main motor 16 and the fixing motor 35 are initiated in listed order, even though the following condition is met: the time period Tf>the time period Tm. In FIG. 9D, the main motor 16 stops at time t6. Long after the main motor 16 stops, the fixing motor 35 stops at time t7.

As is obvious from FIGS. 9A through 9D, in the embodiment example, the last remaining process can be completed faster than it is completed in the comparative example by a difference Tz between time t5 and time t7.

Turning to FIG. 8, when it is not judged as "the time period Tf>the time period Tm" (i.e., when judged as "the time period Tf≦the time period Tm") in Step S12, the main motor 16, which is used for the time-consuming process, is initiated by the high-speed initiation (Step S21) (time t0 of FIG. 10A).

When it is judged that the rotation speed of the main motor 16 has reached the control alteration speed Vs (YES of Step S22), the acceleration control of the main motor 16 is switched to the feedback control (Step S23) (time t11 of FIG. 10A). This completes the high-speed initiation of the main motor 16. As is the case with Step S18, after starting the feedback control of the main motor 16, the process of forming the registration patterns to the process of calculating an amount of position shift of each color, etc. are executed.

In Step S24, the fixing motor 35, which is used for the process that does not take much time, is initiated by the normal initiation (time t12 of FIG. 10B). When it is judged that the rotation speed of the fixing motor 35 has reached the control alteration speed Vs (YES of Step S25), the acceleration control of the fixing motor 35 is switched to the feedback control (Step S26) (time t13 of FIG. 10B). Step S26 is followed by Step S19. With the heat from the fixing heater 33, rotation of the fixing motor 35 drives, rotates and heats the fixing roller 31 and the pressure roller 32.

According to the example of FIGS. 10A and 10B, rotation of the fixing motor 35 stops first (time t14), then rotation of the main motor 16 stops next (time t15). In this example, a time period required between the start and completion of the whole preparation operation (from time t0 to time t15) is equivalent to a time period throughout which the main motor 16 is on, and is longer than a time period throughout which the fixing motor 35 is on. Thus, even when the warm-up is parallelly executed during the color registration correction, such parallel execution does not affect the time period required between the start and completion of the whole preparation operation (i.e., even when the warm-up and the color registration correction are executed in parallel, the warm-up is completed by the time the color registration correction is completed).

Although not illustrated in FIGS. 10A and 10B, the total power consumption of the motors shown in FIGS. 10A and 10B has substantially the same waveform as that shown in FIG. 9C. This is because the motors of FIGS. 10A and 10B have substantially the same output characteristic as those of FIGS. 9A and 9B, and the total power consumption of the motors of FIGS. 10A and 10B is substantially the same as that of FIGS. 9A and 9B, even though the motors were initiated in reverse order. Of course, when motors requiring different power consumptions are used, peak values of the power consumptions of these motors are different from each other; however, even in such a case, each power consumption will still has a waveform having two peaks whose values are not extremely large.

FIG. 10C shows a comparative example where the fixing motor 35 and the main motor 16 are initiated in listed order. Here, the fixing motor 35 stops at time t16. Long after the fixing motor 35 stops, the main motor 16 stops at time t17. That is to say, in the embodiment example, the preparation operation can be completed faster than it is completed in the comparative example by a difference Tz between time t15 and time t17. It should be noted that, as set for the above, the length of the time periods Tf and Tm varies depending on a state of the image formation apparatus at the time of turning on the power. Accordingly, each time the power is turned on, one of the warm-up and the color registration correction is executed first by the high-speed initiation, then the other is executed next by the normal initiation, depending on which one of the time periods Tf and Tm is longer/shorter than another.

As described above, in the present embodiment, a motor used for a time-consuming process is rotated first by the high-speed initiation. Then, upon completion of this initiation, another motor used for a process that does not take much time is rotated next by the normal initiation. With such processes executed in parallel, the capacitance of each motor can be reduced and the preparation operation can be completed in a shorter amount of time. This enables the image formation apparatus to shift to the ready state more promptly.

Embodiment 2

Embodiment 1 has exemplarily described a case where the color registration correction and the warm-up are executed in parallel as the preparation operation with use of the main motor 16 and the fixing motor 35, respectively. Embodiment 2 is different from Embodiment 1 in that there is no fixing motor 35, and the warm-up is to increase the temperature by using the fixing heater. Here, the fixing roller 31 and the pressure roller 32 are driven by the main motor 16. To avoid redundancy, the descriptions of Embodiment 2 that are the same as those of Embodiment 1 will be hereinafter omitted. Constituent elements of Embodiment 2 that have the same structures as those of Embodiment 1 will be assigned the same reference numbers as those assigned to their counterparts of Embodiment 1.

In the present embodiment, the fixing heater 33 is, for example, a halogen heater. The fixing heater 33 is lit when CPU 101 outputs an H-level signal and turned off when CPU outputs an L-level signal as temperature control signals.

Figure 11:
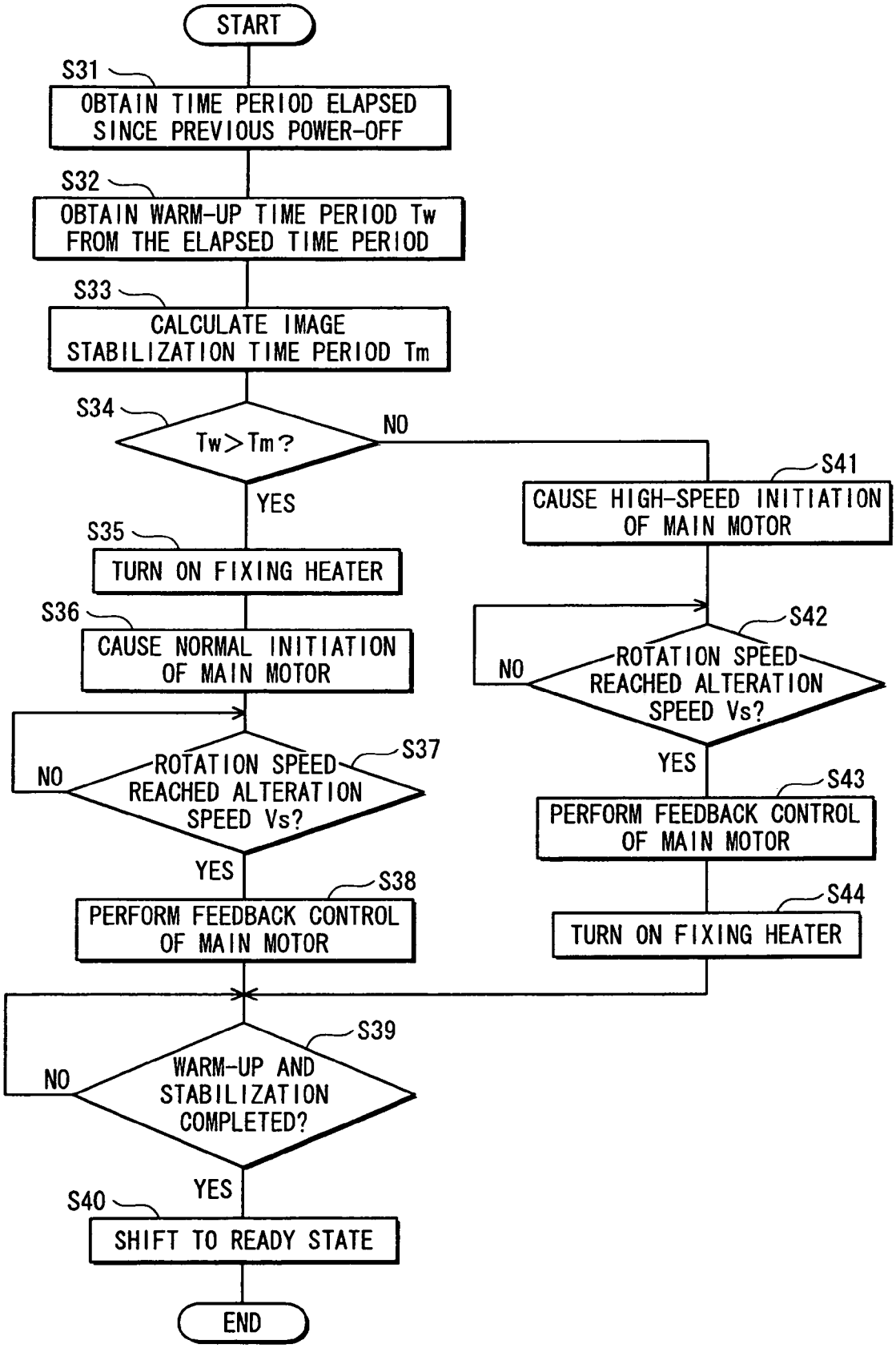
FIG. 11 is a flowchart exemplarily showing details of control over a fixing heater and the main motor that are executed by CPU during a preparation operation pertaining to Embodiment 2.

As shown in FIG. 11, CPU 101 first obtains a time period elapsed between a previous power-off and a present power-on (Step S31). This elapsed time period is timed by a timer (not illustrated), which starts timing upon the previous power-off and times a time period elapsed between the previous power-off and the present power-on.

Next, CPU 101 obtains a warm-up time period Tw from the elapsed time period that has been timed (Step S32). Here, ROM 107 stores therein information indicating, in one-to-one correspondence, (i) time periods X elapsed from the previous power-off, and (ii) time periods Y that are estimated to be required between a start and completion of the warm-up upon the power-on that follows the elapsed time periods X. This information has been obtained in advance from experiments or the like. Once an actual elapsed time period X has been timed, the warm-up time period Tw is obtained by reading out data of an estimated time period Y corresponding to the actual elapsed time period X that has been timed.

The warm-up time period Tw may be obtained in other methods, for example, by multiplying the stated time period Ts1 (a time period for which the fixing heater 33 has to be on to increase the temperature of the fixing roller 31 by one [C°]) by a difference between the current surface temperature of the fixing roller 31 and the target temperature.

Next, CPU 101 obtains the stabilization time period Tm (Step S33). The time period Tm is obtained using the method described in the above Step S11.

When judged as "the time period Tw>the time period Tm" (YES of Step S34), the fixing heater 33 is turned on (Step S35) (time to of FIG. 12A), thereby heating the fixing roller 31.

Figure 12:
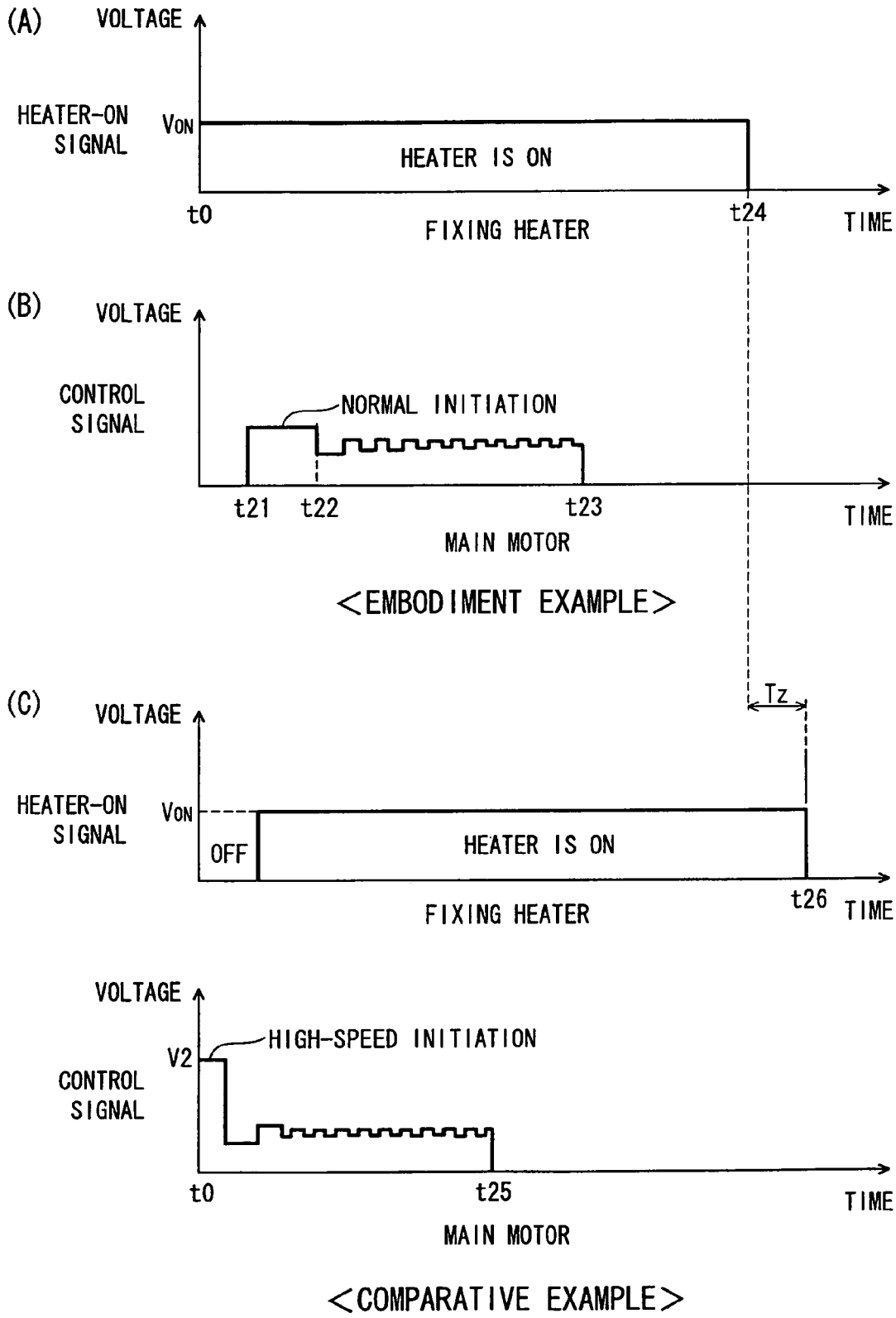
FIGS. 12A and 12B exemplarily show changes in voltage waveforms of a temperature adjustment signal and a control signal that are respectively output from CPU to the fixing heater and the main motor during the preparation operation in Embodiment 2.
FIG. 12C exemplarily shows changes in voltage waveforms of a temperature adjustment signal and a control signal that are respectively output from CPU to the fixing heater and the main motor during the preparation operation in a comparative example.

In Step S36, the main motor 16 is initiated by the normal initiation (time t21 of FIG. 12B). When it is judged that the rotation speed of the main motor 16 has reached the control alteration speed Vs (YES of Step S37), the acceleration control of the main motor 16 is switched to the feedback control (Step S38) (time t22 of FIG. 12B). As is the case with Step S18, after starting the feedback control of the main motor 16, the process of forming the registration patterns 121Y to 121K to the process of calculating an amount of position shift of each color, etc. are executed.

In Step S39, a judgment is made as to whether the warm-up and the image stabilization operations have both been completed. With respect to the warm-up, the judgment is made depending on whether or not a time period elapsed from the time of turning on the fixing heater 33 has reached the time period Tw that has been obtained in Step S31. Note, the judgment about whether the warm-up has been completed or not may be made using other methods. For example, the warm up may be judged to have been completed when it is judged that the roller surface temperature has reached the target temperature from the result of detecting the roller surface temperature. In this case, the time period required between a start and completion of the warm-up may not match the time period Tw. Still, when the warm-up is completed in a shorter time period than the time period Tw, the time period required between the start and completion of the processes would be shorter. The same goes for the color registration correction.

In the embodiment example shown in FIGS. 12A and 12B, rotation of the main motor 16 stops first (time t23), then the fixing heater 33 is turned off next (time t24). In this embodiment example, a time period required between the start and completion of the whole preparation operation (from time t0 to time t24) is equivalent to a time period throughout which the fixing heater 33 is on, and is longer than a time period throughout which the main motor 16 is on. Thus, even when the color registration correction is parallelly executed during the warm-up, such parallel execution does not affect the time period required between the start and completion of the whole preparation operation. Although not illustrated in FIGS. 12A and 12B, a peak of the total power consumption of the fixing heater 33 and the main motor 16 appears during the normal initiation of the main motor 16 (from time t21 to time t22). Here, however, as the main motor 16 is initiated by the normal initiation, the value of this peak will be smaller than the value of a peak that is supposed to appear during the high-speed initiation of the main motor 16 while the heater is on.

Meanwhile, the comparative example of FIG. 12C depicts a case where the fixing heater 33 is turned on after the high-speed initiation of the main motor 16, even when "the time period Tw>the time period Tm". In this case, the main motor 16 stops at time t25. Long after the main motor 16 stops, the fixing heater 33 is turned off at time t26. Consequently, in the embodiment example, the preparation operation is completed faster than it is completed in the comparative example by a difference Tz between the time t24 and the time t26.

Figure 13:
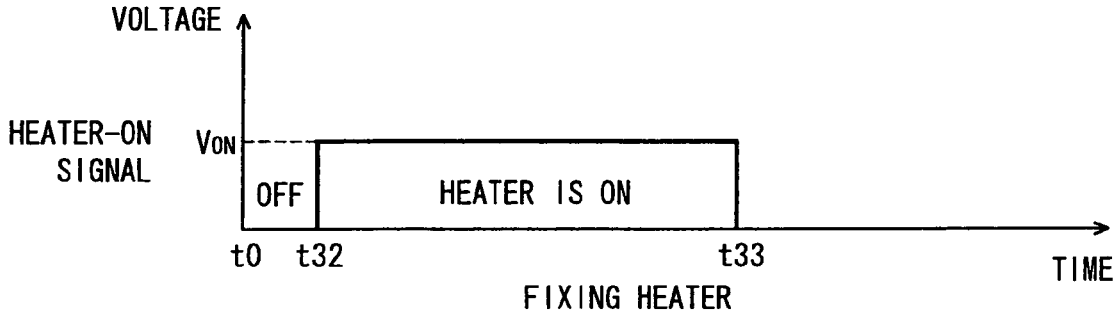
FIGS. 13A and 13B show changes in voltage waveforms of another temperature adjustment signal and another control signal that are respectively output from CPU to the fixing heater and the main motor during the preparation operation, in Embodiment 2.
Figure 13:
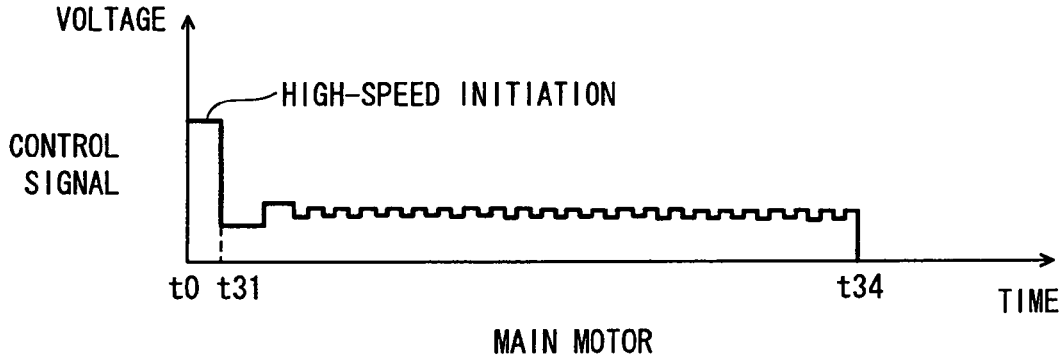

Turning to FIG. 11, when it is not judged as "the time period Tw>the time period Tm" (i.e., when judged as "the time period Tw≦the time period Tm") in Step S34, the main motor 16 is initiated by the high-speed initiation (Step S41) (time t0 of FIG. 13B).

When it is judged that the rotation speed of the main motor 16 has reached the control alteration speed Vs (YES of Step S42), the acceleration control of the main motor 16 is switched to the feedback control (Step S43) (time t31 of FIG. 13B). As is the case with Step S18, after starting the feedback control of the main motor 16, the process of forming the registration patterns to the process of calculating an amount of position shift of each color, etc. are executed.

In Step S44, the fixing heater 33 is turned on (time t32 of FIG. 13A). Step S44 is followed by Step S39. The heat from the fixing heater 33 heats the fixing roller 31.

In the embodiment example of FIGS. 13A and 13B, the fixing heater 33 is turned off first (time t33), then rotation of the main motor 16 stops next (time t34). In this embodiment example, a time period required between the start and completion of the whole preparation operation (from time t0 to time t34) is equivalent to a time period throughout which the main motor 16 is on, and is longer than a time period throughout which the fixing heater 33 is on. Thus, even when the warm-up is parallelly executed during the color registration correction, such parallel execution does not affect the time period required between the start and completion of the whole preparation operation. Although not illustrated in FIGS. 13A and 13B, a peak of the total power consumption of the fixing heater 33 and the main motor 16 appears during the high-speed initiation of the main motor 16 (from time 0 to time t31). Here, during the high-speed initiation of the main motor 16, the fixing heater 33 is off—i.e., the power consumption of the fixing heater 33 is not counted toward the total power consumption. As a result, the value of the peak is smaller than the value of a peak obtained when the power consumption of the fixing heater 33 is counted toward the total power consumption. It should be noted that the power consumption of the main motor 16, which is subjected to the feedback control, is counted toward the total power consumption while the fixing heater 33 is on (from time t32 to time t33). However, because the power consumption of the main motor 16 during the feedback control is smaller than that during the normal initiation, the value of the peak would not increase.

As set forth above, Embodiment 2 has described the following features. When a time-consuming process is to be executed by using a heater, (i) the heater is lighted first, and thereafter, (ii) a motor used for another process that does not take much time is rotated next by the normal initiation. On the other hand, when a time-consuming process is to be executed by using a motor, (i) the motor is rotated first by the high-speed initiation, and thereafter, (ii) upon completion of this high-speed initiation, a heater used for another process that does not require much time is lighted, so that these processes are executed in parallel. This makes it possible to reduce the capacitance of a constituent element that consumes a large amount of power (e.g., the motor and the heater), and to reduce an amount of time required between the start and completion of the whole preparation operation. As a result, the image formation apparatus can shift to the ready state more promptly.

The foregoing has described a case where the halogen heater is used for the fixing heater 33. However, the fixing heater 33 is not limited to the halogen heater, but may instead be a carbon heater, a heating wire, a ceramic heater, a heater of an induction heating (IH) type, and the like.

The present invention is not limited to an image formation apparatus, but may be a method for executing the above-described preparation operation. The present invention may further be a program that causes a computer to execute such a method. Also, the program can be recorded on various types of computer-readable recording media, such as a magnetic disk (e.g., a magnetic tape and a flexible disk), an optical recording medium (e.g., DVD-ROM, DVD-RAM, CD-ROM, CD-R, MO, and PD), and a flash-memory-type recording medium. The program may be produced and traded in the form of the recording medium, and may also be transmitted or distributed via various wired or wireless networks (such as the Internet), broadcast, telecommunication lines, satellite communication, and the like.

Also, the program does not necessarily have to include all modules for causing a computer to execute the processes described above. For example, a computer may be caused to execute each process of the present invention with use of various general-purpose programs that can be installed on another information processing apparatus, such as a communication program and a program included in an operating system (OS). Accordingly, all of the above modules need not necessarily be recorded on the above-described recording medium, and all of the modules do not necessarily need to be transmitted. Furthermore, there may also be a case where a predetermined process is executed with use of dedicated hardware.

Variations

Although the present invention has been described based on the above embodiments, the present invention is not limited to the above embodiments. The following variations are possible.

(1) The above embodiments have exemplarily described a case where the color registration correction is executed as image stabilization control. However, the image stabilization control is not limited to the color registration correction. The image stabilization control but may be anything as long as it is control of (i) forming reference patterns on image carriers (e.g., the photosensitive drums 1 and the intermediate transfer belt 12) in the image former 10 (image forming units) while rotating the image carriers, and (ii) for optimizing conditions of image formation in accordance with a result of detecting the formed reference patterns, the image formation being executed by the image forming units. Examples of the image stabilization control include light quantity correction, maximum density correction, and tone correction. Each correction is executed with use of the main motor 16.

The light quantity correction denotes correcting light quantities of the laser diodes of the exposure units 3Y to 3K. More specifically, the following are performed as the light quantity correction. First, a density pattern for each tone is formed on the rotating intermediate transfer belt 12 by causing changes in the light quantities of the laser diodes and dot density. Next, the density of each of the formed patterns is detected with use of the pattern detection sensor 19. Then, a per-dot light quantity of each laser diode is adjusted for each pattern, such that the density of each pattern conforms to a prescribed density.

The following are performed as the maximum density correction. First, high-density patterns are formed on the intermediate transfer belt 12 by causing each laser diode to emit light with the maximum light quantity. Then, image formation conditions (e.g., charged voltage and developing bias voltage) are adjusted at proper values, so that the formed patterns detected by the pattern detection sensor 19 have the density specified in advance as the maximum density.

The tone correction is a so-called γ correction, and the following are performed as the tone correction. First, certain gradation patterns (input images) are formed on the rotating intermediate transfer belt 12 by causing changes in the light quantities of the laser diodes and dot density, each gradation pattern being composed of a plurality of, for example, 256 tones represented by 256 partial patterns. Next, for each gradation pattern, the density thereof is detected by the pattern detection sensor 19, and a table is generated that shows the relationship between the density of the input image and the density of an image that is actually output. The values shown in the tables (γ tables) are used as control variables for the light quantities of the laser diodes and dot density. When executing a print job, the tone reproducibility is improved by controlling the light quantities of the laser diodes and dot density in accordance with the γ tables, so that the density of the input images and the density of the output images conform to each other.

Assume that the above-described light quantity correction, tone correction, etc. are executed as the image stabilization control. In this case, if the image formation apparatus is configured such that the number of the patterns to be formed varies depending on the length of a time period elapsed from the previous power-off (the power-off time period) as is the case with the color registration correction, then an estimated time period required between a start and completion of the image stabilization control differs each time the power is turned on. Accordingly, based on the time period required between a start and completion of the image stabilization control and the warm-up time period, a judgment is made as to which one of the image stabilization control and the warm-up should be executed first by the high-speed initiation.

It is permissible to execute only one of a plurality of processes including the color registration correction, the light-quantity correction, the tone correction, and so on. It is also permissible to execute a combination of one or more of the plurality of processes.

(2) The foregoing has described that the number of the patterns to be formed is changed during the image stabilization control in accordance with the power-off time period. However, the present invention is not limited to such a structure. The number of the patterns to be formed may not be changed. In this case, every time the correction is executed, it takes the same amount of time to complete the correction. Here, the total operation time period required between a start and completion of the image stabilization control varies in accordance with the power-off time period, if the number of a combination of the processes to be executed is changed in accordance with the length of the power-off time period (for example, if the image formation apparatus is configured such that when the power-off time period has exceeded a predetermined time period, the plurality of corrections are executed in sequence, and when the power-off time period has not exceeded the predetermined time period, only one of the plurality of corrections is executed).

(3) A secondary transfer roller cleaning may be executed as one of the processes included in the preparation operation, independently from the image stabilization control. The secondary transfer roller cleaning is a process for cleaning toners and the like attached to the surface of the secondary transfer roller 25. More specifically, the following are performed as the secondary transfer roller cleaning. While the intermediate transfer belt 12 and the secondary transfer roller 25 are being driven and rotated, voltage having an opposite polarity from the toners is applied to the secondary transfer roller 25. This makes the toners reverse-transferred from the secondary transfer roller 25 onto the rotating intermediate transfer belt 12. Then, the toners, which have been reverse-transferred onto the intermediate transfer belt 12, are removed with a cleaner of the intermediate transfer belt 12.

For example, in a case where a print job executed immediately before the previous power-off was to print on a plurality of small-sized sheets S, it is possible to control the secondary transfer roller cleaning such that the cleaning is executed over a longer time period than the cleaning executed in other cases, due to the following reason.

Assume a case where a print job is to print on a large-sized sheet S. In this case, even if the surface of the secondary transfer roller 25 has attracted toners or the like that are suspended inside the image formation apparatus, the suspended toners or the like would be removed as they are collected by the back of the large-sized sheet S each time the large-sized sheet S passes through the secondary transfer roller 25. Hence, the suspended toners or the like are not easily accumulated.

In contrast, assume a case where a print job executed immediately before the previous power-off was to print on the small-sized sheets S. In this case, as the width of each passing sheet S (i.e., the length of an area of the secondary transfer roller 25 that comes in contact with each passing sheet S in the direction of an axis thereof) is small, some areas of the secondary transfer roller 25 do not come into contact with the sheets S. Accordingly, once the secondary transfer roller 25 has attracted the suspended toners, the suspended toners will not be collected by the sheets S—i.e., they can be easily accumulated. The larger the number of the small-sized sheets S to be printed, the larger the amount of accumulated toners.

Assume that the power is turned off upon completion of a print job of printing on small-sized sheets S, with a large amount of suspended toners accumulated on the secondary transfer roller 25. In this situation, if the power is turned on again and a print job of printing on large-sized sheets S is executed, the suspended toners may be collected by and therefore stain the back of the large-sized sheets S when the suspended toners are accumulated in the areas of the secondary transfer roller 25 that come into contact with the large-sized sheets S.

Hence, in a case where a print job of printing on small-sized sheets S was executed immediately before the previous power-off, it is possible to prevent the above-described stains on the back of a currently-printed sheet by cleaning the secondary transfer roller 25 for a longer time than other cases so as to remove a larger amount of suspended toners or the like that have been accumulated.

The secondary transfer roller cleaning may be executed after the image stabilization control is completed, or the image stabilization control may be executed after the secondary transfer roller cleaning is completed. Alternatively, the secondary transfer roller cleaning and the image stabilization control may be executed in parallel.

(4) Embodiment 1 above has described an exemplary case where two motors—the main motor 16 and the fixing motor 35—are used. However, Embodiment 1 is applicable to a case where three or more direct-current motors (DC motors) are used. For example, the image formation apparatus may be configured to (i) include a first motor for driving the photosensitive drums 1Y to 1K, a second motor for driving the intermediate transfer belt 12, and a fixing motor for driving the fixing roller 31, and (ii) use both of the first and second motors when executing the color registration correction, and use only the second motor when executing the secondary transfer roller cleaning. In this case, the most time-consuming process is executed first by causing the high-speed initiation of a motor used therefor, and thereafter, a plurality of processes other than the most time-consuming process are executed next by causing the normal initiation of motors used therefor. Here, the plurality of processes may be executed using various methods, such as the following: (i) the plurality of processes may be executed at different timings by causing the normal initiation of the corresponding motors, starting from the most time-consuming process and progressing toward the least time-consuming process; (ii) the plurality of processes may be executed by causing the normal initiation of the corresponding motors in parallel, as long as the amount of power consumed to cause the normal initiation of the motors does not exceed the amount of power consumed to cause the high-speed initiation. Provided that the power consumed to cause the high-speed initiation of a motor is regarded as an upper limit, the amount of power supplied is adjusted so that the total amount of power consumed at the time of initiating the motors by the normal initiation does not exceed the upper limit.

(5) The above embodiments have described an exemplary case where the preparation operation is executed when the power of the image formation apparatus is turned on. However, the present invention is not limited to such a structure. For example, the preparation operation may be executed when a power-save mode is terminated, or when an openable and closable exterior cover of the image formation apparatus (not illustrated) is closed after it was opened to fix a paper jam or the like.

Here, the power-save mode is a mode for saving power by reducing power consumption of the image formation apparatus lower power than that during the ready state. In the above embodiments, power supplied to the fixing heater 33 is controlled so that the temperature of the fixer is maintained at a temperature lower than the target temperature.

In a case where the image stabilization control and the secondary transfer roller cleaning are both executed as the preparation operation, and the preparation operation is executed upon the power-on and termination of the power-save mode, the image formation apparatus may be configured to, for example, (i) execute the image stabilization control and the secondary transfer roller cleaning upon the power-on, and (ii) execute only the image stabilization control but not execute the secondary transfer roller cleaning upon termination of the power-save mode. Depending on when the preparation operation is performed, processes to be performed vary, and a time period required between a start and completion of the processes varies as well.

(6) In a case where the preparation operation is executed both upon the power-on and closure of the exterior cover, the image formation apparatus may be configured to (i) execute the image stabilization control when the temperature difference between the temperature inside the image formation apparatus at the time of closure of the exterior cover and the temperature inside the image formation apparatus at the time of executing the previous image stabilization control is larger than a predetermined temperature, and (ii) not execute the image stabilization control when such a temperature difference is smaller than the predetermined temperature. This is because, when such a temperature difference is smaller than the predetermined temperature, the image quality is thought to be preserved without executing the image stabilization control.

The above image formation apparatus may further be configured to (i) execute both of the image stabilization control and the secondary transfer roller cleaning upon the power-on, and (ii) execute only the secondary transfer roller cleaning upon closure of the exterior cover when the above temperature difference is smaller than the predetermined temperature. The above temperature difference may be replaced by a humidity difference between the humidity inside the image formation apparatus at the time of closure of the exterior cover and the humidity inside the image formation apparatus at the time of executing the previous image stabilization control. It is permissible to calculate and utilize both of the temperature difference and the humidity difference.

The image formation apparatus may further be configured to (i) execute the image stabilization control when the accumulated number of the sheets that are printed from previous execution of the image stabilization control to closure of the exterior cover is larger than a predetermined number, and (ii) not execute the image stabilization control when said accumulated number is smaller than the predetermined number.

(7) In the above embodiments, the switching between the high-speed initiation and the normal initiation of a motor (e.g., the main motor 16) is conducted by changing the voltage of the control signal transmitted from CPU 101 to the driver 110. The present invention, however, is not limited to such a structure. The switching may be conducted in any manner, as long as an initiation method can be instructed. For example, it is permissible to predetermine frequencies of control signals that respectively instruct the high-speed initiation and the normal initiation, so that a particular initiation method can be conducted by outputting the control signal corresponding to the particular initiation at the corresponding frequency.

(8) The above embodiments have described an exemplary case where the image formation apparatus of the present invention is applied to the tandem digital color printer. However, the image formation apparatus of the present invention need not necessarily be applied to the tandem digital color printer. The image formation apparatus of the present invention may be applied to a general image formation apparatus that can shift to the ready state (i.e., a state in which image formation is executable) after executing the preparation operation including different processes such as a warm-up, image stabilization control, and a secondary transfer roller cleaning, whether the image formation is executed in color or grayscale. Examples of such a general image formation apparatus include a photocopier, MFP (Multiple Function Peripheral), and a fax machine.

For example, the image formation apparatus of the present invention may be applied to a photocopier or a fax machine that includes a read-in unit for reading in an image of a document and performs, as one of processes included in a preparation operation, image stabilization control on the read-in unit. Here, the image stabilization control includes, for example, the following processes: placing a scanner, which includes a light source or the like, back to a home position by causing a motor to drive the scanner to shift the scanner in the sub-scan direction; and controlling the scanner to stop in a read-in position.

In the above embodiments, a drive motor (e.g., the main motor 16) is described as a direct-current motor. However, it is permissible to use a normal motor that can, depending on an amount of power supplied, change its speed at the time of initiation.

Furthermore, it is permissible to combine the above embodiments and variations.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image formation apparatus that includes at least one motor, executes a preparation operation including a plurality of different processes, and upon completion of the preparation operation, shifts to a ready state in which an image formation operation is executable, the plurality of different processes including at least one process that is executed by driving a corresponding motor of the at least one motor, the image formation apparatus comprising:

an obtainer operable to obtain, for each of the different processes, an estimated time period required between a start and completion of the process; and a controller operable to start execution of, out of the different processes, (i) a process whose estimated time period is longer than the estimated time period of any other process, and thereafter, (ii) the any other process so that the any other process is executed in parallel with the process that has been started, wherein when the process to be started first is included in the at least one process, the controller initiates the corresponding motor by a high-speed initiation by applying thereto a first voltage that is higher than a second voltage, and when the any other process is included in the at least one process, the controller initiates the corresponding motor by a normal initiation by applying thereto the second voltage.

2. The image formation apparatus of claim 1, wherein the at least one process is composed of (i) a first process that is executed by driving a first motor of the at least one motor and (ii) a second process that is executed by driving a second motor of the at least one motor, when the following conditions (i) and (ii) are both satisfied, the controller first initiates the first motor by the high-speed initiation, and thereafter initiates the second motor by the normal initiation: (i) the first process is the process whose estimated time period is longer than the estimated time period of any other process; and (ii) the second process is included in the any other process, and when the following conditions (i) and (ii) are both satisfied, the controller first initiates the second motor by the high-speed initiation, and thereafter initiates the first motor by the normal initiation: (i) the second process is the process whose estimated time period is longer than the estimated time period of any other process; and (ii) the first process is included in the any other process.

3. The image formation apparatus of claim 2, further comprising:

an image former operable to form an image on a rotating image carrier, and transfer the formed image onto a sheet that is conveyed; and a fixer operable to fix the transferred image onto the sheet by heat while causing a rotating fixing member to convey the sheet, the fixing member being-heated by a heater, wherein the first process is image stabilization control of (i) forming a reference pattern on the image carrier while causing the first motor to rotate the image carrier, and (ii) in accordance with a result of detecting the reference pattern, optimizing conditions of image formation executed by the image former, and the second process is a warm-up for increasing a temperature of the fixing member to a target temperature by heating the fixing member with the heater while causing the second motor to rotate the fixing member, the target temperature being a temperature required to perform the fixing.

4. The image formation apparatus of claim 1, wherein:

the different processes include a first process that is executed by driving a heater, the at least one process is composed of a second process that is executed by driving a first motor of the at last one motor, when the following conditions (i) and (ii) are both satisfied, the controller first starts supplying electric power to the heater, and thereafter initiates the first motor by the normal initiation: (i) the first process is the process whose estimated time period is longer than the estimated time period of any other process; and (ii) the second process is included in the any other process, and when the following conditions (i) and (ii) are both satisfied, the controller first initiates the first motor by the high-speed initiation, and thereafter starts supplying the electric power to the heater: (i) the second process is the process whose estimated time period is longer than the estimated time period of any other process; and (ii) the first process is included in the any other process.

5. The image formation apparatus of claim 4, further comprising:

an image former operable to form an image on a rotating image carrier, and transfer the formed image onto a sheet that is conveyed; and a fixer operable to fix the transferred image onto the sheet by heat while causing a heated fixing member to convey the sheet, wherein the first process is a warm-up for increasing a temperature of the fixing member to a target temperature by heating the fixing member with the heater, the target temperature being a temperature required to perform the fixing, and the second process is image stabilization control of (i) forming a reference pattern on the image carrier while causing the first motor to rotate the image carrier, and (ii) in accordance with a result of detecting the reference pattern, optimizing conditions of image formation executed by the image former.

6. The image formation apparatus of claim 5, wherein the controller causes execution of the preparation operation when a power of the image formation apparatus is turned on, the obtainer includes:

a timer operable to time a time period elapsed between (i) time at which the power is turned off and (ii) time at which the power is turned on next time; and a warm-up time period estimator operable to, in accordance with a length of the elapsed time period that has been timed, calculate a time period that is estimated to be required to complete the warm-up, and the obtainer obtains the calculated time period as the estimated time period required between the start and the completion of the first process.

7. The image formation apparatus of claim 4, wherein the controller performs same electric power supply control on the heater, whether or not the first process is the process to be started first.

8. The image formation apparatus of claim 1, wherein the controller causes execution of the preparation operation at one of the following timings: (i) when a power of the image formation apparatus is turned on; (ii) when a power-save mode, during which electric power consumption is maintained lower than electric power consumption during the ready state, is terminated; and (iii) when an openable and closable cover of the image formation apparatus is opened or closed by a user.

9. The image formation apparatus of claim 1, wherein an amount of electric power supplied during the high-speed initiation and the normal initiation has been set, so that an amount of electric power consumed to execute the process to be started first during the high-speed initiation and an amount of electric power consumed to execute the any other process during the normal initiation remain equal to or below a predetermined value.

10. An image formation apparatus that executes a preparation operation including a first process and a second process, and upon completion of the preparation operation, shifts to a ready state in which an image formation operation is executable, the image formation apparatus comprising:

an image former operable to form an image on an image carrier that is rotated by a motor, and transfer the formed image onto a sheet that is conveyed;

a fixer operable to fix the transferred image onto the sheet by heat while causing a fixing member to convey the sheet, the fixing member being heated by a heater;

a driver operable to drive and rotate the motor by switching between a normal initiation and a high-speed initiation, the normal initiation initiating the motor by applying thereto a first voltage, and the high-speed initiation initiating the motor by applying thereto a second voltage that is higher than the first voltage;

an obtainer operable to obtain, for each of the first process and the second process, an estimated time period required between a start and completion of the process, the first process being executed by causing the motor to rotate the image carrier, and the second process being executed by causing the heater to heat the fixing member; and a controller operable to start execution of, out of the first process and the second process, (i) a process whose estimated time period is longer than the estimated time period of another process, and thereafter, (ii) the other process so that the other process is executed in parallel with the process that has been started, wherein the controller initiates the motor by (i) the high-speed initiation when the first process is the process to be started first, and (ii) the normal initiation when the first process is the other process to be started second, and the controller performs same electric power supply control on the heater, whether the second process is the process to be started first or the other process to be started second.

11. A preparation operation execution method used in an image formation apparatus that includes at least one motor, executes a preparation operation including a plurality of different processes, and upon completion of the preparation operation, shifts to a ready state in which an image formation operation is executable, the plurality of different processes including at least one process that is executed by driving a corresponding motor of the at least one motor, the preparation operation execution method comprising:

an obtaining step for obtaining, for each of the different processes, an estimated time period required between a start and completion of the process; and a controlling step for starting execution of, out of the different processes, (i) a process whose estimated time period is longer than the estimated time period of any other process, and thereafter, (ii) the any other process so that the any other process is executed in parallel with the process that has been started, wherein when the process to be started first is included in the at least one process, the controlling step initiates the corresponding motor by a high-speed initiation by applying thereto a first voltage that is higher than a second voltage, and when the any other process is included in the at least one process, the controlling step initiates the corresponding motor by a normal initiation by applying thereto the second voltage.

12. The preparation operation execution method of claim 11, wherein the at least one process is composed of (i) a first process that is executed by driving a first motor of the at least one motor and (ii) a second process that is executed by driving a second motor of the at least one motor, when the following conditions (i) and (ii) are both satisfied, the controlling step first initiates the first motor by the high-speed initiation, and thereafter initiates the second motor by the normal initiation: (i) the first process is the process whose estimated time period is longer than the estimated time period of any other process; and (ii) the second process is included in the any other process, and when the following conditions (i) and (ii) are both satisfied, the controlling step first initiates the second motor by the high-speed initiation, and thereafter initiates the first motor by the normal initiation: (i) the second process is the process whose estimated time period is longer than the estimated time period of any other processes; and (ii) the first process is included in the any other process.

13. The preparation operation execution method of claim 12, wherein the image formation apparatus further includes:

an image former operable to form an image on a rotating image carrier, and transfer the formed image onto a sheet that is conveyed; and a fixer operable to fix the transferred image onto the sheet by heat while causing a rotating fixing member to convey the sheet, the fixing member being heated by a heater, the first process is image stabilization control of (i) forming a reference pattern on the image carrier while causing the first motor to rotate the image carrier, and (ii) in accordance with a result of detecting the reference pattern, optimizing conditions of image formation executed by the image former, and the second process is a warm-up for increasing a temperature of the fixing member to a target temperature by heating the fixing member with the heater while causing the second motor to rotate the fixing member, the target temperature being a temperature required to perform the fixing.

14. The preparation operation execution method of claim 11, wherein the different processes include a first process that is executed by driving a heater, the at least one process is composed of a second process that is executed by driving a first motor of the at least one motor, when the following conditions (i) and (ii) are both satisfied, the controlling step first starts supplying electric power to the heater, and thereafter initiates the first motor by the normal initiation: (i) the first process is the process whose estimated time period is longer than the estimated time period of any other process; and (ii) the second process is included in the any other process, and when the following conditions (i) and (ii) are both satisfied, the controlling step first initiates the first motor by the high-speed initiation, and thereafter starts supplying the electric power to the heater: (i) the second process is the process whose estimated time period is longer than the estimated time period of any other process; and (ii) the first process is included in the any other process.

15. The preparation operation execution method of claim 14, wherein the image formation apparatus further includes:

an image former operable to form an image on a rotating image carrier, and transfer the formed image onto a sheet that is conveyed; and a fixer operable to fix the transferred image onto the sheet by heat while causing a heated fixing member to convey the sheet, the first process is a warm-up for increasing a temperature of the fixing member to a target temperature by heating the fixing member with the heater, the target temperature being a temperature required to perform the fixing, and the second process is image stabilization control of (i) forming a reference pattern on the image carrier while causing the first motor to rotate the image carrier, and (ii) in accordance with a result of detecting the reference pattern, optimizing conditions of image formation executed by the image former.

16. The preparation operation execution method of claim 15, wherein the controlling step causes execution of the preparation operation when a power of the image formation apparatus is turned on, the obtaining step includes:

a timing substep for timing a time period elapsed between (i) time at which the power is turned off and (ii) time at which the power is turned on next time; and a warm-up time period estimating substep for, in accordance with a length of the elapsed time period that has been timed, calculating a time period that is estimated to be required to complete the warm-up, and the obtaining step obtains the calculated time period as the estimated time period required between the start and the completion of the first process.

17. The preparation operation execution method of claim 14, wherein in executing the first process, the controlling step performs same electric power supply control on the heater, whether or not the first process is the process to be started first.

18. The preparation operation execution method of claim 11, wherein the controlling step causes execution of the preparation operation at one of the following timings: (i) when a power of the image formation apparatus is turned on; (ii) when a power-save mode, during which electric power consumption is maintained lower than electric power consumption during the ready state, is terminated in the image formation apparatus; and (iii) when an openable and closable cover of the image formation apparatus is opened or closed by a user.

19. The preparation operation execution method of claim 11, wherein the controlling step executes the high-speed initiation and the normal initiation, so that an amount of electric power consumed to execute the process to be started first during the high-speed initiation and an amount of electric power consumed to execute the any other process during the normal initiation remain equal to or below a predetermined value.

20. A preparation operation execution method used in an image formation apparatus that executes a preparation operation including a first process and a second process, and upon completion of the preparation operation, shifts to a ready state in which an image formation operation is executable, wherein the image formation apparatus includes:

an image former operable to form an image on an image carrier that is rotated by a motor, and transfer the formed image onto a sheet that is conveyed; and a fixer operable to fix the transferred image onto the sheet by heat while causing a fixing member to convey the sheet, the fixing member being heated by a heater, the first process is executed by causing the motor to rotate the image carrier, and the second process is executed by causing the heater to heat the fixing member, the preparation operation execution method includes:

an obtaining step for obtaining, for each of the first process and the second process, an estimated time period required between a start and completion of the process; and a controlling step for starting execution of, out of the first process and the second process, (i) a process whose estimated time period is longer than the estimated time period of another process, and thereafter, (ii) the other process so that the other process is executed in parallel with the process that has been started, the controlling step initiates the motor by (i) a high-speed initiation by applying thereto a first voltage, which is higher than a second voltage, when the first process is the process to be started first, and (ii) a normal initiation by applying thereto the second voltage when the first process is the other process to be started second, and the controlling step performs same electric power supply control on the heater, whether the second process is the process to be started first or the other process to be started second.

* * * * *